US008871701B2

(12) United States Patent
Bierganns et al.

(10) Patent No.: US 8,871,701 B2
(45) Date of Patent: Oct. 28, 2014

(54) EMULSIONS FOR REMOVAL AND PREVENTION OF DEPOSITS

(75) Inventors: Patric Bierganns, Krefeld (DE); Markus Broecher, Muhlheim an der Ruhr (DE); Charlotta Kanto-Oeqvist, Kempen (DE)

(73) Assignee: Solenis LLC, Wilmington, DE (US)

( * ) Notice: Subject to any disclaimer, the term of this patent is extended or adjusted under 35 U.S.C. 154(b) by 71 days.

(21) Appl. No.: 13/771,860

(22) PCT Filed: Aug. 12, 2011

(86) PCT No.: PCT/EP2011/004067

§ 371 (c)(1),
(2), (4) Date: May 10, 2013

(87) PCT Pub. No.: WO2012/022451

PCT Pub. Date: Feb. 23, 2012

(65) Prior Publication Data

US 2013/0237467 A1 Sep. 12, 2013

(30) Foreign Application Priority Data

Aug. 20, 2010 (EP) ..... 10008719

(51) Int. Cl.

| | |
|---|---|
| ***C11D 3/44*** | (2006.01) |
| ***C11D 1/72*** | (2006.01) |
| ***D21C 9/08*** | (2006.01) |
| ***C11D 17/00*** | (2006.01) |
| ***C11D 1/825*** | (2006.01) |
| ***C11D 3/43*** | (2006.01) |
| *C11D 1/74* | (2006.01) |
| *C11D 1/66* | (2006.01) |
| *C11D 3/18* | (2006.01) |

(52) U.S. Cl.

CPC ..... *C11D 17/0017* (2013.01); *D21C 9/08* (2013.01); *C11D 1/74* (2013.01); *C11D 1/662* (2013.01); *C11D 3/18* (2013.01); *C11D 1/825* (2013.01); *C11D 1/72* (2013.01); *C11D 3/43* (2013.01)

USPC ..... 510/417; 510/174; 510/181; 510/211; 510/213; 510/364; 510/365; 510/421; 510/427; 510/432; 510/463

(58) Field of Classification Search

USPC ..... 510/174, 181, 211, 213, 364, 365, 417, 510/427, 421, 432, 463

See application file for complete search history.

(56) References Cited

U.S. PATENT DOCUMENTS

| | | | | |
|---|---|---|---|---|
| 5,139,116 | A * | 8/1992 | Screen | 188/1.12 |
| 5,139,616 | A | 8/1992 | Ling | |
| 6,150,452 | A | 11/2000 | Ling et al. | |

FOREIGN PATENT DOCUMENTS

| | | |
|---|---|---|
| CA | 2291882 | 6/2001 |
| DE | 4136445 | 6/1991 |
| EP | 517360 | 4/1992 |
| EP | 558360 | 1/1993 |
| EP | 562739 | 1/1993 |
| EP | 731776 | 10/1993 |
| EP | 828889 | 5/1996 |
| WO | 0109434 | 2/2001 |
| WO | 2006097321 | 9/2006 |
| WO | 2012022451 | 2/2012 |

OTHER PUBLICATIONS

International Search Report PCT/EP2011/004067, dated Oct. 26, 2011, pp. 1-2.

D.R. Caccioni et al., Int J Food Microbiol, 1998, 18 43 (1-2), 73-9).

Griffin WC: Journal of the Society of Cosmetic Chemists 1 (1949): 311.

Griffin WC: Journal of the Society of Cosmetic Chemists 5 (1954): 259.

Davies JT: Gas/Liquid and Liquid/Liquid Interface. Proceedings of the International Congress of Surface Activity (1957: 426-438).

* cited by examiner

*Primary Examiner* — Charles Boyer

(74) *Attorney, Agent, or Firm* — Joanne Rossi; Michael Herman

(57) ABSTRACT

The invention relates to an aqueous cleansing emulsion comprising a hydrophobic component $H_1$ selected from the group consisting of the following categories: (i) aliphatic $C_{10}$- or $C_{15}$-terpene hydrocarbons; (ii) aliphatic $C_{10}$- or $C_{15}$-terpenoids; (iii) aliphatic $C_{15}$-$C_{40}$-hydrocarbons; and (iv) $C_6$-$C_{30}$-carboxylic acid $C_1$-$C_{30}$-alkyl esters. A hydrophobic component $H_2$ selected from the group consisting of the following categories: (iii) aliphatic $C_{15}$-$C_{40}$-hydrocarbons; (iv) $C_6$-$C_{30}$-carboxylic acid $C_1$-$C_{30}$-alkyl esters; (v) aliphatic $C_6$-$C_{19}$-hydrocarbons; (vi) aromatic $C_{10}$- or $C_{15}$-terpenoids; (vii) aliphatic or aromatic $C_{20}$-, $C_{25}$-, $C_{30}$- or $C_{35}$-terpenoids; (viii) essential, animal or vegetable oils; and (ix) silicon oils. Furthermore, the emulsion contains an emulsifier $E_1$ having a HLB value of 4±2; an emulsifier $E_2$ having a HLB value of 9±2; and optionally, an emulsifier $E_3$ having an HLB value of 16±4.

11 Claims, 6 Drawing Sheets

EMULSIONS FOR REMOVAL AND PREVENTION OF DEPOSITS

This application claims the benefit of PCT/EP2011/004067, Filed 12 Aug. 2011, the entire contents of which are hereby incorporated by reference.

FIELD OF THE INVENTION

The invention relates to aqueous emulsions that are suitable for removal and prevention of organic and inorganic deposits on surfaces of water-bearing systems.

BACKGROUND OF RELATED TECHNOLOGY

Deposits of inorganic or organic composition form a fundamental problem as regards the operation of industrial plants in which fluids, particularly aqueous media, move through pipe systems or are stored (intermediately) in containers.

Water-bearing-systems, such as water and waste water pipings, cooling or heating cycles, cooling lubricant systems, drilling fluids, or industrial process waters for the transport of matter contain a variety of substances (organic, inorganic and/or microbiological) that tend to form deposits in the systems. As a result these deposits adhere as to parts of plants, form sediments and are removed in the form of larger portions, and they result in disturbances in aggregates and production masses.

Such deposits often occur in the form of films. These are formed primarily in aqueous systems at the interface with a solid phase. In case of micro-organisms caused films, they consist of a slimy layer in which micro-organisms (e.g. bacteria, algae, fungi, and protozoa) are embedded. As a rule, these films contain, other than the micro-organisms, primarily water and extra-cellular polymeric substances exuded by the micro-organisms which, in conjunction with the water, form hydro-gels and contain other nutrients or substances. Often, particles are included in the resulting slimy matrix that is found in the aqueous medium adjacent the interface.

The formation of deposits in papermaking plants is problematic, particularly in the components that are used for the accommodation and transfer of an aqueous fiber suspension. The film (also called "fouling") which forms in such a papermaking plant is also characterized by the fact that it contains a high proportion of fibers, fine substances, and inorganic pigments that are bound by the organic matrix. Such films typically are accompanied by protective exopolysaccharides ("slime", EPS) of microbiological sources and occur at the interface of these equipment surfaces and process water streams. Additionally, inorganic contaminants, such as calcium carbonate ("scale") and organic contaminants often deposit on such surfaces. These organic contaminants are typically known as "pitch" (e.g., resins from wood) and "stickies" (e.g., glues, adhesives, tape, and wax particles).

If the layer thickness of the deposit is too great, it might break away from the substrate. The portions thus released might cause faulty operation, particularly tearing of the paper webs during paper manufacture, which leads to high consequential costs. In order to avoid this, deposit control agents are added.

EP-A 562 739 proposes to control slime formation by means of compositions containing glutaraldehyde and 2-(thiocyanomethylthio)-benzothiazole. EP 558 360 A1 proposes to use special disinfectants to fight bacteria strains of the genus *Staphylococcus* or *Acinobacter*.

DE-A 41 36 445 describes the increase of the nitrogen and phosphate content in the aqueous medium in order to influence the growth of microorganisms under decomposition of already existing slimy substances and proposes to use sporadically known microbiocides for this purpose, such as isothiazolones (trade name Kathoon), dibromonitrilopropionamide, or methylene bisisothiocyanate.

To recycle waste paper, EP-A 517 360 describes the use of a mixture consisting of a surfactant and a hydrocarbon, in particular terpene, in order to inhibit tacky impurities in the pulp. Until today, volatile terpenoids are known to have an allelopathic action in plants.

EP-A 731 776 and EP-A 828 889 disclose oil-in-water emulsions as deposit control agents which are formed from a hydrophobic phase, at least one emulsifier and water and which comprise in the hydrophobic phase at least one active ingredient which is selected from the following group of substances used alone or in admixture:

1.) a saturated or unsaturated, open-chain or cyclic, normal or isomeric hydrocarbon having 8-30 carbon atoms;
2.) a saturated or unsaturated fatty alcohol, a saturated or unsaturated fatty acid, a fatty acid monoalkyl ester, a fatty acid amide, or a fatty acid monoalkylamide of a saturated or unsaturated fatty acid, all of the compounds listed under 2.) having 8 to 30 carbon atoms;
3.) a mono- or polyester of a saturated or unsaturated fatty acid with 4 to 30 carbon atoms and monoalcohols and/or polyols, with the exception of polyethylene glycols;
4.) a polyamide of saturated or unsaturated fatty acids having 8 to 30 carbon atoms and aliphatic polyamines having 2 to 6 nitrogen atoms;
5.) an acyclic, preferably monocyclic and/or bicyclic terpene, in particular a terpene hydrocarbon and/or a terpene alcohol; and/or
6.) a polyoxyalkylene compound based on alkylene oxides and $C_{12}$-$C_{18}$ fatty alcohols and/or $C_{12}$-$C_{18}$ fatty acids and/or fatty acid glycerides of $C_{12}$-$C_{18}$ fatty acids.

The deposit control agents of the prior art, however, are not satisfactory in every respect. There is a demand for cleaning compositions that are useful for removing and/or preventing deposits from surfaces of water-bearing systems which have advantages compared to conventional cleaning compositions.

SUMMARY OF THE INVENTION

The invention relates to an aqueous cleansing emulsion comprising (a) a hydrophobic component $H_1$ selected from the group consisting of the following categories:
  (i) aliphatic $C_{10}$- or $C_{15}$-terpene hydrocarbons;
  (ii) aliphatic $C_{10}$- or $C_{15}$-terpenoids; and
  (iii) aliphatic $C_{15}$-$C_{40}$-hydrocarbons, preferably $C_{20}$-$C_{40}$-hydrocarbons;
  (iv) $C_6$-$C_{30}$-carboxylic acid $C_1$-$C_{30}$-alkyl esters, preferably excluding animal or vegetable oils;

(b) a hydrophobic component $H_2$ selected from the group consisting of the following categories:
  (iii) aliphatic $C_{15}$-$C_{40}$-hydrocarbons, preferably $C_{20}$-$C_{40}$-hydrocarbons;
  (iv) $C_6$-$C_{30}$-carboxylic acid $C_1$-$C_{30}$-alkyl esters, preferably excluding animal or vegetable oils;
  (v) aliphatic $C_6$-$C_{19}$-hydrocarbons, preferably $C_6$-$C_{14}$-hydrocarbons, preferably excluding aliphatic $C_{10}$- or $C_{15}$-terpene hydrocarbons;
  (vi) aromatic $C_{10}$- or $C_{15}$-terpenoids;
  (vii) aliphatic or aromatic $C_{20}$-, $C_{25}$-, $C_{30}$- or $C_{35}$-terpenoids;
  (viii) essential oils, preferably excluding aliphatic $C_{10}$- or $C_{15}$-terpene hydrocarbons, aliphatic $C_{10}$- or $C_{15}$-terpenoids, aromatic $C_{10}$- or $C_{15}$-terpenoids, and aliphatic or aromatic $C_{20}$-, $C_{25}$-, $C_{30}$- or $C_{35}$-terpenoids; animal or vegetable oils, preferably excluding $C_6$-$C_{30}$-carboxylic acid $C_1$-$C_{30}$-alkyl esters; and (ix) silicon oils;

with the with the proviso that $H_1$ and $H_2$ are neither both selected from category (iii) nor both selected from category (iv);

(c) an emulsifier $E_1$ having a HLB value of 4±2; and (d) an emulsifier $E_2$ having a HLB value of 9±2.

It has been surprisingly found that the aqueous cleansing emulsions according to the invention provide superior results compared to deposit control agents of the prior art.

It has been surprisingly found, that the aqueous cleansing emulsions according to the invention may exhibit enhanced contaminant control performance compared to cleansing emulsions of the prior art.

Further, it has been surprisingly found that the aqueous cleansing emulsions according to the invention as such additionally exhibit defoaming properties. It has been found that said aqueous emulsions are suitable for controlling both the formation of deposits and foam formation in aqueous systems such as the white water circuit of a papermaking machine. The addition of foaming agents may thus be completely omitted or at least be reduced to comparatively low amounts in order to sufficiently suppress foam formation.

Still further, it has been surprisingly found that combining the two types of hydrophobic compounds $H_1$ and $H_2$ in the form of the cleansing emulsion according to the invention increases the shelf life compared to cleansing emulsions containing only one type of these hydrophobic compounds significantly. This especially holds for cleansing emulsions containing paraffin and thus being especially prone to degradation.

Furthermore, it has been found that the aqueous cleansing emulsion according to the invention exhibits antimicrobial activity towards *Meiothermus silvanus* which is a colored biofilm forming species ubiquitous in papermaking machines.

DETAILED DESCRIPTION OF THE INVENTION

Figure 1:
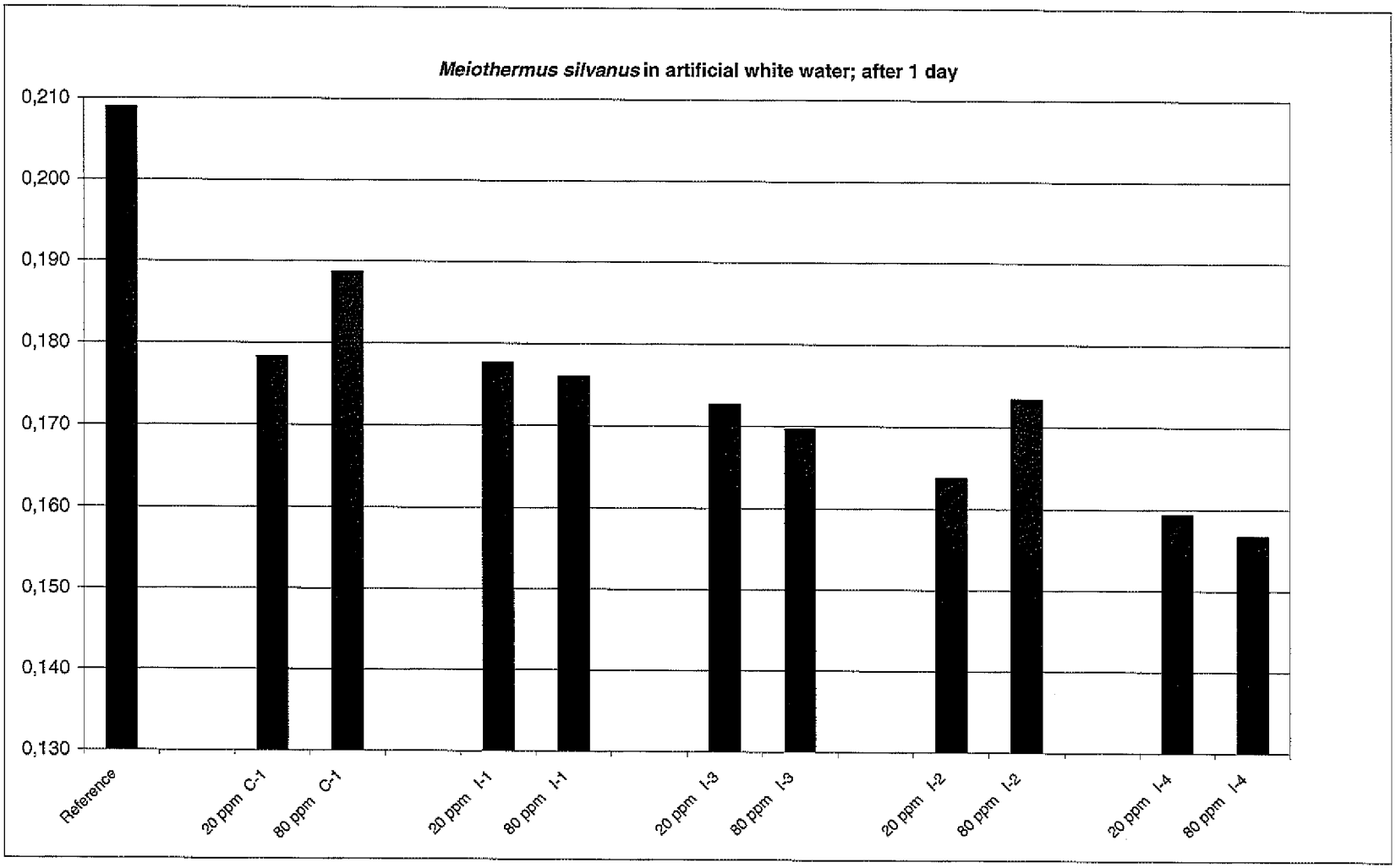
FIG. 1, illustrates results of a microtiterplate assay test of the present inventions ability to prevent deposit formation with comparative cleansing emulsion C-1.
Figure 2:
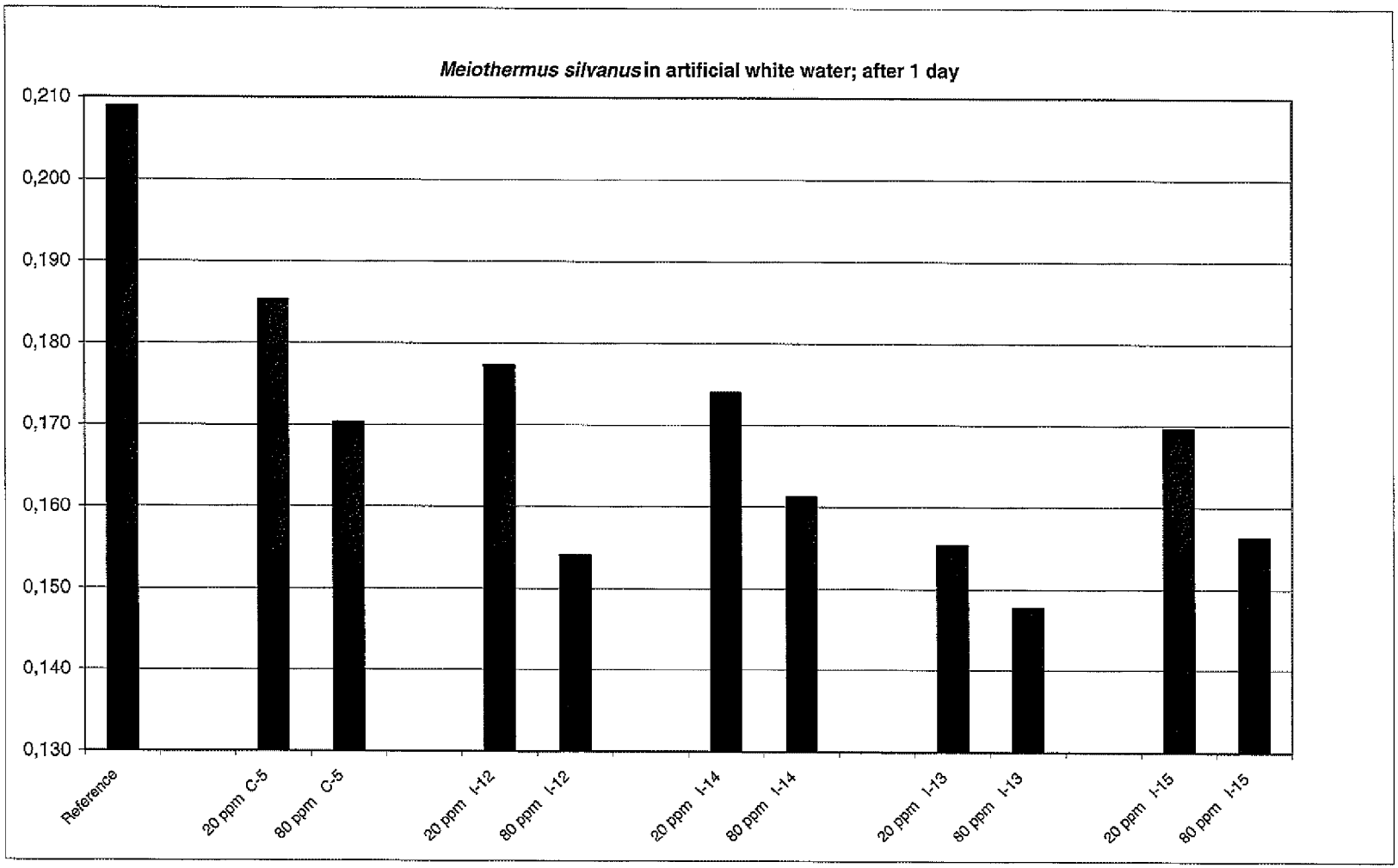
FIG. 2, illustrates results of a microtiterplate assay test of the present inventions ability to prevent deposit formation with comparative cleaning emulsion C-5.

The invention relates to an aqueous cleansing emulsion comprising (a) a hydrophobic component $H_1$ selected from the group consisting of the following categories:

aliphatic $C_{10}$- or $C_{15}$-terpene hydrocarbons;

(ii) aliphatic $C_{10}$- or $C_{15}$-terpenoids;

(iii) aliphatic $C_{15}$-$C_{40}$-hydrocarbons, preferably $C_{20}$-$C_{40}$-hydrocarbons; and (iv) $C_6$-$C_{30}$-carboxylic acid $C_1$-$C_{30}$-alkyl esters, preferably excluding animal or vegetable oils;

(b) a hydrophobic component $H_2$ selected from the group consisting of the following categories:

(iii) aliphatic $C_{15}$-$C_{40}$-hydrocarbons, preferably $C_{20}$-$C_{40}$-hydrocarbons;

(iv) $C_6$-$C_{30}$-carboxylic acid $C_1$-$C_{30}$-alkyl esters, preferably excluding animal or vegetable oils;

(v) aliphatic $C_6$-$C_{19}$-hydrocarbons, preferably $C_6$-$C_{14}$-hydrocarbons, preferably excluding aliphatic $C_{10}$- or $C_{15}$-terpene hydrocarbons;

(vi) aromatic $C_{10}$- or $C_{15}$-terpenoids;

(vii) aliphatic or aromatic $C_{20}$-, $C_{25}$-, $C_{30}$- or $C_{35}$-terpenoids;

(viii) essential oils, preferably excluding aliphatic $C_{10}$- or $C_{15}$-terpene hydrocarbons, aliphatic $C_{10}$- or $C_{15}$-terpenoids, aromatic $C_{10}$- or $C_{15}$-terpenoids, and aliphatic or aromatic $C_{20}$-, $C_{25}$-, $C_{30}$- or $C_{35}$-terpenoids; animal or vegetable oils, preferably excluding $C_6$-$C_{30}$-carboxylic acid $C_1$-$C_{30}$-alkyl esters; and (ix) silicon oils;

with the with the proviso that $H_1$ and $H_2$ are neither both selected from category (iii) nor both selected from category (iv);

(c) an emulsifier $E_1$ having a HLB value of 4±2;

(d) an emulsifier $E_2$ having a HLB value of 9±2; and (e) optionally, an emulsifier $E_3$ having an HLB value of 16±4.

Terpenes are known to the person skilled in the art. Terpenes are a large and varied class of hydrocarbons, produced primarily by a wide variety of plants, particularly conifers, though also by some insects such as termites or swallowtail butterflies.

For the purpose of the specification "terpene hydrocarbons" may be regarded as conjugates of isoprene ($C_5H_8$) that consist of carbon atoms and hydrogen atoms, i.e. do not bear functional groups (e.g. alcohols, ethers, aldehydes, ketones, epoxides and the like). For the purpose of the specification, terpene hydrocarbons also encompass those compounds that are obtained by rearrangement of the carbon skeleton of other terpene hydrocarbons. Examples of terpene hydrocarbons include monoterpenes ($C_{10}$-terpene hydrocarbons) and sesquiterpenes ($C_{15}$-terpene hydrocarbons), which can be linear, branched and/or cyclic, unsaturated or saturated, aliphatic or aromatic. Examples of $C_{10}$-terpene hydrocarbons include ocimen, myrcen, menthan, α-terpinen, γ-terpinen, terpinolen, α-phellandren, β-phellandren, limonen, caran, pinan, bornan, α-pinen, and β-pinen. Examples of $C_{15}$-terpene hydrocarbons include bisabolen, cardinen, β-selinen, cadinen, cadalen, vetivazulen, guajazulen.

For the purpose of the specification "terpenoids" differ from "terpene hydrocarbons" in that they are no pure hydrocarbons but bear at least one functional group (e.g. alcohols, ethers, aldehydes, ketones, epoxides and the like). Thus, terpenoids are distinguished from terpene hydrocarbons—there is no overlap. For the purpose of the specification, terpenoids also encompass those compounds that are obtained by rearrangement of the carbon skeleton of other terpenoids. Examples of terpenoids include monoterpenoids ($C_{10}$-terpenoids), sesquiterpenoids ($C_{15}$-terpenoids), diterpenoids ($C_{20}$-terpenoids), sesterterpenoids ($C_{25}$-terpenoids), triterpenoids ($C_{30}$-terpenoids) and tetranortriterpenoids ($C_{35}$-terpenoids), which can be linear, branched and/or cyclic, unsaturated or saturated, aliphatic or aromatic. Examples of $C_{10}$-terpenoids include geraniol, nerol, linalool, citronellol, ipsenol, citral, pseudojonon, α-jonon, β-jonon, thymol, menthol, terpineole (e.g., α-terpineole, β-terpineole, γ-terpineole, δ-terpineole), 1,8-terpin, 1,8-cineol, menthon, pulgeon, carved, carvon, carvacrol, caron, verbenon, campher, carvenon, borneol. Examples of $C_{15}$-terpenoids include farnesol, nerolidol. Examples of $C_{20}$-terpenoids include phytol, vitamin A, abientinic acid.

Aliphatic hydrocarbons may be linear, branched and/or cyclic, unsaturated or saturated. Examples include alkanes, alkenes, alkynes, cycloalkanes, cycloalkenes and cycloalkyns.

$C_6$-$C_{30}$-carboxylic acid $C_1$-$C_{30}$-alkyl esters include monoesters of monocarboxylic acids, diesters of dicarboxylic acids but preferably no monoesters of dicarboxylic acids. Examples of monocarboxylic acids include fatty acids and examples of dicarboxylic acids include adipic acid.

Essential oils are also known to the person skilled in the art. For the purpose of the specification, essential oils include pure compounds and particularly, compound mixtures. Typically, essential oils are concentrated, hydrophobic liquids containing volatile aroma compounds from plants. They are also known as "volatile oils" or "ethereal oils". Many essential oils are complex mixtures of various ingredients and contain as main ingredients terpene hydrocarbons and/or terpenoids. They can analytically be identified by the specific pattern of the various ingredients. For example, D-limonene, a terpene hydrocarbon, is one of the most common terpene hydrocarbons in nature. It is a major constituent in several citrus oils (orange, lemon, mandarin, lime, and grapefruit). However, said citrus oils do not consist of D-limonene exclusively (cf., e.g., D. R. Caccioni et al., Int J Food Microbiol. 1998, 18, 43(1-2), 73-9). Animal oils include musk, beef fat, beef foot oil, seal oil, fish oils and whale oils. Vegetable oils include soybean oil, corn oil, sunflower seed oil, high-oleic sunflower seed oil, canola oil, safflower oil, cuphea oil, jojoba oil, coconut oil, and palm kernel oil.

Emulsifiers are known to the person skilled in the art. An emulsifier (also known as an emulgent) is a substance which stabilizes an emulsion (mixture of immiscible fluids). Emulsifiers typically have a hydrophobic and a hydrophilic end. The emulsifiers surround hydrophobic molecule aggregates and form a protective layer so that they cannot "clump" together. This action helps to keep the dispersed phase in small droplets and preserves the emulsion. Emulsifiers can be divided into water-in-oil emulsifiers (w/o emulsifiers) that stabilize water-in-oil emulsions (water dispersed in a continuous phase of oil) and oil-in-water emulsifiers (o/w emulsifiers) that stabilize oil-in-water emulsions (oil dispersed in a continuous phase of water).

Emulsifiers can be classified according to their HLB value (hydrophilic-lipophilic balance; cf. e.g., Griffin W C: Journal of the Society of Cosmetic Chemists 1 (1949): 311; Griffin W C: Journal of the Society of Cosmetic Chemists 5 (1954): 259; Davies J T: Gas/Liquid and Liquid/Liquid Interface. Proceedings of the International Congress of Surface Activity (1957): 426-438). In a preferred embodiment, the HLB value of the emulsifiers according to the invention is defined according to Griffin. In another preferred embodiment, the HLB value of the emulsifiers according to the invention is defined according to Davies. The HLB value can be used, e.g., to predict the surfactant properties of a molecule: a HLB value of 0 to 3 is typical for antifoaming agents, a HLB value of 4 to 6 is typical for w/o emulsifiers, a HLB value of 7 to 9 is typical for wetting agents, a HLB value of 8 to 18 is typical for o/w emulsifiers, a HLB value of 13 to 15 is typical for detergents and a HLB value of 10 to 18 is typical for solubilizers or hydrotropes.

The cleansing emulsion according to the invention is aqueous.

In a preferred embodiment, water is the continuous phase, i.e. the emulsion is an oil-in-water emulsion. According to this embodiment, the water content of the emulsion is preferably at least 25 wt.-%, more preferably at least 40 wt.-%, still more preferably at least 50 wt.-%, yet more preferably at least 60 wt.-%, and in particular at least 70 wt.-%, based on the total weight of the emulsion.

In another preferred embodiment, water is the dispersed phase, i.e. the emulsion is a water-in-oil emulsion. According to this embodiment, the water content of the emulsion is preferably at most 80 wt.-%, more preferably at most 70 wt.-%, still more preferably at most 60 wt.-%, yet more preferably at most 50 wt.-%, most preferably at most 40 wt.-% and in particular at most 25 wt.-%, based on the total weight of the emulsion.

In a preferred embodiment, the cleansing emulsion according to the invention is provided as a concentrate. Said concentrate can be used as such, or can be diluted when applying the emulsion to a water bearing system. The water of the water bearing system causes dilution and thus, increases the water content of the composition that comes into contact with the surfaces that are to be cleaned. Preferably, the concentrate is a water-in-oil emulsion that is spontaneously inverted into an oil-in-water emulsion upon dilution with water.

The cleansing emulsion according to the invention contains at least the following components: water, hydrophobic component $H_1$, hydrophobic component $H_2$, emulsifier $E_1$ and emulsifier $E_2$.

Hydrophobic component $H_1$ is selected from the group consisting of the following categories:

aliphatic $C_{10}$- or $C_{15}$-terpene hydrocarbons, preferably $C_{10}$-terpene hydrocarbons;

(ii) aliphatic $C_{10}$- or $C_{15}$-terpenoids, preferably $C_{10}$-terpene alcohols;

(iii) aliphatic $C_{16}$-$C_{40}$-hydrocarbons, preferably $C_{20}$-$C_{40}$-hydrocarbons, preferably solid paraffins; and (iv) $C_6$-$C_{30}$-carboxylic acid $C_1$-$C_{30}$-alkyl esters, preferably excluding animal or vegetable oils.

Preferably, category (i) comprises monocyclic saturated or unsaturated $C_{10}$-terpene hydrocarbons; more preferably monocyclic unsaturated $C_{10}$-terpene hydrocarbons; still more preferably monocyclic unsaturated $C_{10}$-terpene hydrocarbons containing two unconjugated or conjugated C═C-double bonds; yet more preferably monocyclic unsaturated $C_{10}$-terpene hydrocarbons containing an exocyclic C═C-double bond and an unconjugated C═C-double bond in the cycle; most preferably limonene; particularly D-(+)-limonene.

Preferably, category (ii) comprises monocyclic saturated or unsaturated $C_{10}$-terpene alcohols; more preferably monocyclic unsaturated $C_{10}$-terpene alcohols; still more preferably monocyclic unsaturated $C_{10}$-terpene alcohols containing one C═C-double bond that is exocyclic or in the cycle; most preferably terpineole, particularly R-(+)-α-terpineole, S-(−)-α-terpineole, β-terpineole, γ-terpineole and/or δ-terpineole.

Preferably, category (iii) comprises aliphatic $C_{15}$-$C_{40}$-alkanes, preferably $C_{20}$-$C_{40}$-alkanes and aliphatic $C_{15}$-$C_{40}$-alkenes, preferably $C_{20}$-$C_{40}$-alkenes. Examples of aliphatic $C_{20}$-$C_{40}$-alkanes include acyclic aliphatic $C_{20}$-$C_{40}$-alkanes such as eicosane ($C_{20}$), heneicosane ($C_{21}$), docosane ($C_{22}$), tricosane ($C_{23}$), tetracosane ($C_{24}$), pentacosane ($C_{25}$), hexacosane ($C_{26}$), heptacosane ($C_{27}$), octacosane ($C_{28}$), nonacosane ($C_{29}$), triacontane ($C_{33}$), dotriacontane ($C_{32}$), tritriacontane ($C_{34}$), tetratriacontane ($C_{34}$), hexatriacontane ($C_{36}$), heptatriacontane ($C_{37}$), octatriacontane ($C_{38}$), nonatriacontane ($C_{39}$), tetracontane ($C_{40}$). Examples of aliphatic $C_{20}$-$C_{40}$-alkenes include acyclic aliphatic $C_{20}$-$C_{40}$-alkenes such as 1-eicosene ($C_{20}$) and (Z)-9-tricosene ($C_{23}$). Preferably, category (iii) comprises $C_{20}$-$C_{40}$-paraffins, more preferably solid paraffins, still more preferably solid paraffins having a melting point (ASTM D 87 and ASTM D 127, respectively) within the range of 49±15° C., preferably 49±10° C., more preferably 49±8° C., still more preferably 49±8° C., yet more preferably 49±4° C., most preferably 49±2° C., and in particular 49±1° C. Said paraffins may comprise hydrocarbons with less than 20 C-atoms (belonging to category (iv))), e.g. n-paraffin mix $C_{18}$, $C_{20}$, $C_{22}$, $C_{24}$, or all hydrocarbons have at least 20 C-atoms, e.g. n-paraffin mix $C_{22}$, $C_{24}$, $C_{28}$, $C_{32}$ or n-paraffin mix $C_{24}$, $C_{28}$, $C_{32}$, $C_{36}$.

Preferably, category (iv) comprises monoesters of linear, saturated or unsaturated monocarboxylic acids or diesters of linear, saturated or unsaturated dicarboxylic acids. Examples of monoesters of linear, saturated or unsaturated mono-carboxylic acids include methyl esters of fatty acids which can be prepared, e.g., by transmethylation of oils. When said oils are derived from different fatty acids, the resultant methyl esters will be present as a mixture. For example, rapeseed oil methyl ester can be prepared by transmethylation of rapeseed oil. Other examples of such methyl esters include palm oil methyl ester, soya oil methyl ester, colza oil methyl ester and/or tallow methyl ester. Rapeseed oil methyl ester, soya oil methyl ester and colza oil methyl ester are particularly preferred. Examples of diesters of linear, saturated or unsaturated dicarboxylic acids include methyl diesters, ethyl diesters, propyl diesters and butyl diesters of oxalic acid, malonic acid, succinic acid, glutaric acid, adipic acid, pimelic acid, suberic acid, azelaic acid and sebacic acid. Dibutyladipate is particularly preferred. To avoid overlaps, animal and vegetable oils are preferably excluded from category (iv).

Hydrophobic component $H_2$ is selected from the group consisting of the following categories:

(iii) aliphatic $C_{15}$-$C_{40}$-hydrocarbons, preferably $C_{20}$-$C_{40}$-hydrocarbons;

(iv) $C_6$-$C_{30}$-carboxylic acid $C_1$-$C_{30}$-alkyl esters, preferably excluding animal or vegetable oils;

(v) aliphatic $C_6$-$C_{10}$-hydrocarbons, preferably $C_6$-$C_{14}$-hydrocarbons, preferably excluding aliphatic $C_{10}$- or $C_{15}$-terpene hydrocarbons;

(vi) aromatic $C_{10}$- or $C_{15}$-terpenoids;

(vii) aliphatic or aromatic $C_{20}$, $C_{25}$-, $C_{30}$- or $C_{35}$-terpenoids;

(viii) essential oils, preferably excluding aliphatic $C_{10}$- or $C_{15}$-terpene hydrocarbons, aliphatic $C_{10}$- or $C_{15}$-terpenoids, aromatic $C_{10}$- or $C_{15}$-terpenoids, and aliphatic or aromatic $C_{20}$-, $C_{25}$-, $C_{30}$- or $C_{35}$-terpenoids; animal or vegetable oils, preferably excluding $C_6$-$C_{30}$-carboxylic acid $C_1$-$C_{30}$-alkyl esters; and (ix) silicon oils;

with the with the proviso that $H_1$ and $H_2$ are neither both selected from category (iii) nor both selected from category (iv).

In a preferred embodiment, category (iii) comprises aliphatic $C_{15}$-$C_{40}$-hydrocarbons and category (v) comprises $C_6$-$C_{14}$-hydrocarbons, preferably excluding aliphatic $C_{10}$- or $C_{15}$-terpene hydrocarbons.

In another preferred embodiment, category (iii) comprises $C_{20}$-$C_{40}$-hydrocarbons and category (v) comprises aliphatic $C_6$-$C_{19}$-hydrocarbons, preferably excluding aliphatic $C_{10}$- or $C_{15}$-terpene hydrocarbons.

The cleansing emulsion according to the invention may contain a plurality of ingredients of category (iii), e.g. a mixture of several aliphatic $C_{15}$-$C_{40}$-hydrocarbons, preferably $C_{20}$-$C_{40}$ hydrocarbons such as n-paraffin mix $C_{22}$, $C_{24}$, $C_{28}$, $C_{32}$. However, under these circumstances at least one further ingredient of the cleansing emulsion must be selected from any of categories (i), (ii) and (iv) (hydrophobic component $H_1$) or from any of categories (iv), (v), (vi), (vii), (viii) and (ix) (hydrophobic component $H_2$).

Similarly, the cleansing emulsion according to the invention may contain a plurality of ingredients of category (iv), i.e. a mixture of several $C_6$-$C_{30}$-carboxylic acid $C_1$-$C_{30}$-alkyl esters. However, under these circumstances at least one further ingredient of the cleansing emulsion must be selected from any of categories (i), (ii) and (iii) (hydrophobic component $H_1$) or from any of categories (v), (vi), (vii), (viii) and (ix) (hydrophobic component $H_2$).

Preferably, category (v) comprises aliphatic $C_6$-$C_{19}$-alkanes, preferably, preferably $C_6$-$C_{14}$-alkanes, and aliphatic $C_6$-$C_{19}$-alkenes, preferably $C_6$-$C_{14}$-alkenes. Examples of aliphatic $C_6$-$C_{19}$-alkanes include acyclic aliphatic $C_6$-$C_9$-alkanes such as 2,2-dimethylbutane, 2,3-dimethylbutane, 2-methylpentane, 3-methylpentane, isohexane, n-hexane ($C_6$); 2,2,3-trimethylbutane, 2,2-dimethylpentane, 2,4-dimethylpentane, 2-methyl-hexane, 3,3-dimethylpentane, 3-methylhexane, isoheptane, n-heptane ($C_7$); 2,2,3,3-tetra-methylbutane, 2,2-dimethylhexane, 2,3,4-trimethylpentane, 2,4-dimethylhexane, 2,5-dimethylhexane, 2-methylheptane, 3,4-dimethylhexane, 3-methylheptane, 4-methylheptane, isooctane, n-octane ($C_8$); 2,2,4-trimethylhexane, 2,3-dimethylheptane, 2-methyloctane, isononane, n-nonane ($C_9$); 2-methylnonane, 3-methylnonane, 4-methylnonane, isodecane, n-decane ($C_{10}$); isoundecane, n-undecane ($C_{11}$); isododecane, n-dodecane ($C_{12}$); isotridecane, n-tridecane ($C_{13}$); isotetradecane, n-tetradecane ($C_{14}$); isopentadecane, n-pentadecane ($C_{15}$); isohexadecane, 2,2,4,4,6,8,8-Heptamethylnonane, n-hexadecane ($C_{16}$); isoheptadecane, n-heptadecane ($C_{17}$); isooctadecane, n-octadecane ($C_{18}$); isononadecane, n-nonadecane ($C_{19}$). Further examples of aliphatic $C_6$-$C_{19}$-alkanes include cyclic aliphatic $C_6$-$C_9$-alkanes such as methylcyclopentane, cyclohexane ($C_6$); cycloheptatriene, norbornane, cycloheptane, ethylcyclopentane ($C_7$); 1,1-dimethylcyclohexane, 1,2-dimethylcyclohexane, 1,3-dimethylcyclohexane, 1,4-dimethylcyclohexane, cyclooctane, ethylcyclohexane, propylcyclopentane ($C_8$); 1,2,4-trimethylcyclohexane, isopropylcyclohexane, propylcyclohexane, cyclononane ($C_9$); adamantane, decahydronaphthalene, butylcyclohexane, cyclodecano ($C_{10}$); 1,3-dimethyladamantane, bicyclohexyl ($C_{12}$); perhydrofluorene ($C_{13}$). Examples of aliphatic $C_6$-$C_{19}$-alkenes include acyclic and cyclic aliphatic $C_6$-$C_{19}$-alkenes such as 1,3-hexadiene, 1,4-hexadiene, 1,5-hexadiene, 2,3-dimethyl-1,3-butadiene, 2,4-hexadiene, 2-methyl-1,4-pentadiene, 3-methyl-1,3-pentadiene, 3-methyl-1,4-pentadiene, 4-methyl-1,3-pentadiene, methylenecyclopentane, 1-hexene, 2,3-dimethyl-1-butene, 2,3-dimethyl-2-butene, 2-ethyl-1-butene, 2-hexene, 2-methyl-1-pentene, 2-methyl-2-pentene, 3,3-dimethyl-1-butene, 3-methyl-1-pentene, 3-methyl-2-pentene, 4-methyl-1-pentene, 3-hexene, 3-methyl-2-pentene ($C_6$); 1,6-heptadiene, 2,4-dimethyl-1,3-pentadiene, 2-methyl-1,5-hexadiene, methylenecyclo-hexane, 1-heptene, 2,3,3-trimethyl-1-butane, 2,3-dimethyl-1-pentene, 2-methyl-1-hexene, 3-ethyl-1-pentene, 3-ethyl-2-pentene, 3-heptene, 3-methyl-1-hexene, 4,4-dimethyl-1-pentene, 4-methyl-1-hexene, 5-methyl-1-hexene, 2-heptene ($C_7$); 1,7-octadiene, 2,5-dimethyl-1,5-hexadiene, 2,5-dimethyl-2,4-hexadiene, 2,5-dimethyl-2,4-hexadiene, allylcyclopentane, ethylidenecyclohexane, vinylcyclohexane, 1-octene, 2,3,4-trimethyl-2-pentene, 2,4,4-trimethyl-1-pentene, 2,4,4-trimethyl-2-pentene, 2-methyl-1-heptene, 2-methyl-2-heptene, diisobutylene, 2-octene, 3-octene, 4-octene, 5-ethylidene-2-norbornene, 5-vinyl-2-norbornene, 1,8-nonadiene, 1-isopropyl-1-cyclohexene, allylcyclohexane, 1-nonene, 4-nonene ($C_9$); dipentene, 1,5,9-decatriene, 2,6-dimethyl-2,4,6-octatriene, camphene, myrcene, ocimene, 1,9-decadiene, vinylcyclooctane, 1-decene, 2-methyl-1-nonene, 3,7-dimethyl-1-octene, 5-decene ($C_{10}$); 1-undecene ($C_{11}$); 1,2,4-trivinylcyclohexane, 1-dodecene, 2-methyl-1-undecene ($C_{12}$); 1-tridecene ($C_{13}$); 1-tetradecene, 7-tetradecene ($C_{14}$); γ-humulene, 1-pentadecene ($C_{15}$); 1,15-hexadecadiene, 1-hexadecene ($C_{16}$); 1-heptadecene ($C_{17}$); 1-octadecene ($C_{18}$); 1-nonadecene, 2-methyl-7-octadecene ($C_{19}$). Preferred are liquid paraffins such as white oils. To avoid overlaps, aliphatic $C_{10}$- or $C_{15}$-terpene hydrocarbons are preferably excluded from category (iv).

Preferably, category (vi) comprises aromatic $C_{10}$-terpene alcohols. Examples of aromatic $C_{10}$-terpene alcohols include thymol and carvacrol, the main ingredients of thyme oil.

Preferably, category (vii) comprises tetranortriterpenoids, preferably limonoids, particularly azadirachtin, an ingredient of neem oil.

Preferably, category (viii) comprises essential, animal or vegetable oils selected from the group consisting of amyris oil, almond oil, anise oil, balm oil, basil oil, bay oil, bergamot oil, birch oil, birch tar oil, black pepper oil, borage oil, cade oil, camphor white oil, canaga oil, cardamom oil, carrot seed oil, cassia oil, castor oil, cedar leaf oil, cedarwood oil, celery seed oil, chamomile oil, cinnamon bark oil, cinnamon leaf oil, cinnamon oil, citronella oil, clary sage oil, clove oil, clove bud oil, cod liver oil, cognac oil, copaiba balsam oil, coriander oil, corn oil, cornmint oil, coconut oil, costus oil, cottonseed oil, croton oil, dillweed oil, eucalyptus oil, eugenol, fennel oil, fir needle oil, fish liver oil, galbanum oil, garlic oil, ginger oil, grapefruit oil, guaiac wood oil, jojoba oil, lard oil, lavender oil, lemon oil, lemongrass oil, lime oil, linseed oil, litsea cubeba oil, lovage oil, macadamia nut oil, marjoram oil, mandarin oil, menhaden fish oil, myrrh oil, neem oil, nutmeg oil, olibanum oil, olive oil, onion oil, opoponax oil, orange oil, orange terpenes, osmanthus oil, parsley oil, patchouli oil, peanut oil, peppermint oil, petitgrain oil, pimenta leaf oil, rose oil, rosemary oil, safflower oil, sage oil, sandalwood oil, sassafras oil, sesame oil, soybean oil, spearmint oil, spike lavender oil, sunflower seed oil, tarragon oil, tea tree oil, terpineol, turpentine oil, thyme oil, wheat germ oil, wintergreen oil, ylang-ylang oil. To avoid overlaps, aliphatic $C_{10}$- or $C_{15}$-terpene hydrocarbons, aliphatic $C_{10}$- or $C_{15}$-terpenoids, aromatic $C_{10}$ or $C_{15}$-terpenoids, and aliphatic or aromatic $C_{20}$-, $C_{25}$-, $C_{30}$- or $C_{35}$-terpenoids are preferably excluded from the essential oils of category (viii); and $C_6$-$C_{30}$-carboxylic acid $C_1$-$C_{30}$-alkyl esters are preferably excluded from the animal and vegetable oils of category (viii).

Preferably, category (ix) comprises silicon oils, preferably alkoxylated silicon oils. Preferred alkoxylated silicon oils include ethoxylated (EO) and propoxylated (PO) silicon oils. Preferred they have a EO content within the range of 1 to 55. Most preferable 15 to 35. Preferred The PO content shall be within the range of 1 to 85. Most preferable 20 to 50. Preferred silicon oils have a weight average molecular weight within the range of 1000 to 100000. Preferred silicon oils have a flash point over 60° C. Preferred silicon oils have a cloud point below 30° C.

In preferred embodiments of the cleansing emulsion, $H_1$ is selected from category (i) and $H_2$ is selected from category (iii); or $H_1$ is selected from category (i) and $H_2$ is selected from category (iv); or \$H_1$ is selected from category (i) and $H_2$ is selected from category (v); or $H_1$ is selected from category (i) and $H_2$ is selected from category (vi); or $H_1$ is selected from category (i) and $H_2$ is selected from category (vii); or $H_1$ is selected from category (i) and $H_2$ is selected from category (viii); or $H_1$ is selected from category (i) and $H_2$ is selected from category (ix); or $H_1$ is selected from category (ii) and $H_2$ is selected from category (iii); or $H_1$ is selected from category (ii) and $H_2$ is selected from category (iv); or $H_1$ is selected from category (ii) and $H_2$ is selected from category (v); or $H_1$ is selected from category (ii) and $H_2$ is selected from category (vi); or $H_1$ is selected from category (ii) and $H_2$ is selected from category (vii); or $H_1$ is selected from category (ii) and $H_2$ is selected from category (viii); or $H_1$ is selected from category (ii) and $H_2$ is selected from category (ix); or $H_1$ is selected from category (iii) and $H_2$ is selected from category (iv); or $H_1$ is selected from category (iii) and $H_2$ is selected from category (v); or $H_1$ is selected from category (iii) and $H_2$ is selected from category (vi); or $H_1$ is selected from category (iii) and $H_2$ is selected from category (vii); or $H_1$ is selected from category (iii) and $H_2$ is selected from category (viii); or $H_1$ is selected from category (iii) and $H_2$ is selected from category (ix); or $H_1$ is selected from category (iv) and $H_2$ is selected from category (v); or $H_1$ is selected from category (iv) and $H_2$ is selected from category (vi); or $H_1$ is selected from category (iv) and $H_2$ is selected from category (vii); or $H_1$ is selected from category (iv) and $H_2$ is selected from category (viii); or $H_1$ is selected from category (iv) and $H_2$ is selected from category (ix).

Preferred combinations of hydrophobic components $H_1$ and hydrophobic components $H_2$ include combinations of fatty acid alkyl esters, preferably fatty acid methyl esters, with oils selected from the group consisting of essential oils, animal oils and vegetable oils.

Particularly preferred combinations of hydrophobic components $H_1$ and hydrophobic components $H_2$ are summarized in the table here below:

| $H_1$ | $H_2$ |
|---|---|
| solid paraffin | clove oil |
| solid paraffin | eugenol |
| solid paraffin | neem oil |
| solid paraffin | azadirachtin |
| solid paraffin | thyme oil |
| solid paraffin | thymol |
| solid paraffin | carvacrol |
| solid paraffin | pine oil |
| solid paraffin | terpineole |
| solid paraffin | pinene |
| solid paraffin | cadinene |
| solid paraffin | liquid paraffin |
| solid paraffin | orange oil |

-continued

| $H_1$ | $H_2$ |
|---|---|
| solid paraffin | orange terpene |
| solid paraffin | limonene |
| solid paraffin | rapeseed oil methyl ester |
| solid paraffin | terpinolen |
| solid paraffin | eucalyptus oil |
| solid paraffin | silicon oil |
| orange terpene | clove oil |
| orange terpene | eugenol |
| orange terpene | neem oil |
| orange terpene | azadirachtin |
| orange terpene | thyme oil |
| orange terpene | thymol |
| orange terpene | carvacrol |
| orange terpene | pine oil |
| orange terpene | terpineole |
| orange terpene | pinene |
| orange terpene | cadinene |
| orange terpene | liquid paraffin |
| orange terpene | rapeseed oil methyl ester |
| orange terpene | terpinolen |
| orange terpene | eucalyptus oil |
| orange terpene | silicon oil |
| limonene | clove oil |
| limonene | eugenol |
| limonene | neem oil |
| limonene | azadirachtin |
| limonene | thyme oil |
| limonene | thymol |
| limonene | carvacrol |
| limonene | pine oil |
| limonene | terpineole |
| limonene | pinene |
| limonene | cadinene |
| limonene | liquid paraffin |
| limonene | rapeseed oil methyl ester |
| limonene | terpinolen |
| limonene | eucalyptus oil |
| limonene | silicon oil |
| terpineole | clove oil |
| terpineole | eugenol |
| terpineole | neem oil |
| terpineole | azadirachtin |
| terpineole | thyme oil |
| terpineole | thymol |
| terpineole | carvacrol |
| terpineole | pine oil |
| terpineole | pinene |
| terpineole | cadinene |
| terpineole | liquid paraffin |
| terpineole | rapeseed oil methyl ester |
| terpineole | terpinolen |
| terpineole | eucalyptus oil |
| terpineole | silicon oil |
| rapeseed oil methyl ester | clove oil |
| rapeseed oil methyl ester | eugenol |
| rapeseed oil methyl ester | neem oil |
| rapeseed oil methyl ester | azadirachtin |
| rapeseed oil methyl ester | thyme oil |
| rapeseed oil methyl ester | thymol |
| rapeseed oil methyl ester | carvacrol |
| rapeseed oil methyl ester | pine oil |
| rapeseed oil methyl ester | terpineole |
| rapeseed oil methyl ester | pinene |
| rapeseed oil methyl ester | cadinene |
| rapeseed oil methyl ester | liquid paraffin |
| rapeseed oil methyl ester | orange oil |
| rapeseed oil methyl ester | orange terpene |
| rapeseed oil methyl ester | limonene |
| rapeseed oil methyl ester | terpinolen |
| rapeseed oil methyl ester | eucalyptus oil |
| rapeseed oil methyl ester | silicon oil |
| soybean oil methyl ester | clove oil |
| soybean oil methyl ester | eugenol |
| soybean oil methyl ester | neem oil |
| soybean oil methyl ester | azadirachtin |
| soybean oil methyl ester | thyme oil |
| soybean oil methyl ester | thymol |

-continued

| $H_1$ | $H_2$ |
|---|---|
| soybean oil methyl ester | carvacrol |
| soybean oil methyl ester | pine oil |
| soybean oil methyl ester | terpineole |
| soybean oil methyl ester | pinene |
| soybean oil methyl ester | cadinene |
| soybean oil methyl ester | liquid paraffin |
| soybean oil methyl ester | orange oil |
| soybean oil methyl ester | orange terpene |
| soybean oil methyl ester | limonene |
| soybean oil methyl ester | terpinolen |
| soybean oil methyl ester | eucalyptus oil |
| soybean oil methyl ester | silicon oil |
| castor oil methyl ester | clove oil |
| castor oil methyl ester | eugenol |
| castor oil methyl ester | neem oil |
| castor oil methyl ester | azadirachtin |
| castor oil methyl ester | thyme oil |
| castor oil methyl ester | thymol |
| castor oil methyl ester | carvacrol |
| castor oil methyl ester | pine oil |
| castor oil methyl ester | terpineole |
| castor oil methyl ester | pinene |
| castor oil methyl ester | cadinene |
| castor oil methyl ester | liquid paraffin |
| castor oil methyl ester | orange oil |
| castor oil methyl ester | orange terpene |
| castor oil methyl ester | limonene |
| castor oil methyl ester | terpinolen |
| castor oil methyl ester | eucalyptus oil |
| castor oil methyl ester | silicon oil |
| terpinolen | clove oil |
| terpinolen | eugenol |
| terpinolen | neem oil |
| terpinolen | azadirachtin |
| terpinolen | thyme oil |
| terpinolen | thymol |
| terpinolen | carvacrol |
| terpinolen | pine oil |
| terpinolen | terpineole |
| terpinolen | pinene |
| terpinolen | cadinene |
| terpinolen | liquid paraffin |
| terpinolen | orange oil |
| terpinolen | orange terpene |
| terpinolen | limonene |
| terpinolen | rapeseed oil methyl ester |
| terpinolen | eucalyptus oil |
| terpinolen | silicon oil |

Preferably, the relative weight ratio of hydrophobic component $H_1$:hydrophobic component $H_2$ is within the range of from 50:1 to 1:50, more preferably 40:1 to 1:10, still more preferably 30:1 to 1:1, yet more preferably 20:1 to 2:1, most preferably 15:1 to 3:1, and in particular 10:1 to 4:1.

The cleansing emulsion according to the invention contains at least (c) an emulsifier $E_1$ having a HLB value of 4±2 and (d) an emulsifier $E_2$ having a HLB value of 9±2. Optionally, the emulsion additionally contains (e) an emulsifier $E_3$ having an HLB value of 16±4. Emulsifiers $E_1$, $E_2$ and optionally present emulsifier $E_3$ may be independently of one another anionic, cationic or non-ionic.

In embodiment, emulsifier $E_1$ has a HLB value of 4±2, preferably of 4±1, particularly of ~3, ~4 or ~5. Examples of emulsifiers $E_1$ include $C_{12}$-$C_{18}$-alkylalcohols, e.g. 1-dodecanol, 1-tetradecanol, 1-hexadecanol or 1-octadecanol. Preferably, the content of emulsifier $E_1$ is within the range of from 0.01 to 10 wt.-%, more preferably 0.1 to 8.0 wt.-%, still more preferably 0.5 to 7.0 wt.-%, yet more preferably 0.75 to 5.0 wt.-%, most preferably 1.0 to 4.0 wt.-% and in particular 1.5 to 3.5 wt.-%.

In another preferred embodiment, emulsifier $E_2$ has a HLB value of 9±2, preferably of 9±1, particularly of ~8, ~9 or ~10.

Examples of emulsifiers $E_2$ include polyethoxylated $C_{16}$-$C_{18}$ alkylalcohols and polyethoxylated castor oil. Preferably, the content of emulsifier $E_2$ is within the range of from 0.01 to 10 wt.-%, more preferably 0.1 to 8.0 wt.-%, still more preferably 0.5 to 7.0 wt.-%, yet more preferably 0.75 to 5.0 wt.-%, most preferably 1.0 to 4.0 wt.-% and in particular 1.5 to 3.5 wt.-%.

In yet another preferred embodiment, emulsifier $E_3$ has a HLB value of 16±4, preferably of 16±3, more preferably 16±2, still more preferably 16±1, particularly of ~15, 16, ~17, ~18, ~19 or ~20. Examples of emulsifiers $E_3$ include ethoxylated $C_{16}$-$C_{18}$ alkyl-alcohols, ocenol and alkylpolysaccharides. Preferably, the content of emulsifier $E_3$ is within the range of from 0.01 to 10 wt.-%, more preferably 0.1 to 8.0 wt.-%, still more preferably 0.5 to 7.0 wt.-%, yet more preferably 0.75 to 5.0 wt.-%, most preferably 1.0 to 4.0 wt.-% and in particular 1.5 to 3.5 wt.-%.

Further suitable emulsifiers are known to the person skilled in the art. In this regard it can be referred to, e.g., H. Schubert, Emulgiertechnik, Behr, 1st ed., 2005.

Preferably, the overall content of all emulsifiers is within the range of from 5.0 to 15 wt.-%, based on the total weight of the emulsion.

The emulsion according to the invention further may comprise further ingredients such as corrosion inhibitors and surfactants.

Preferably, the emulsion is not employed in combination with a defoaming agent or is combined with a defoaming agent in such an amount that the defoaming ability of the defoaming agent is not sufficient to achieve the desired defoaming effect in absence of the emulsion according to the invention.

Preferably, the emulsion according to the invention further comprises a corrosion inhibitor. Corrosion inhibitors are known to the person skilled in the art. In this regard it can be referred to, e.g., Vedula S. Sastri, Corrosion Inhibitors: Principles and Applications, Wiley, 1998 and Michael and Irene Ash, Handbook of Corrosion Inhibitors (Synapse Chemical Library), Synapse Information Resources, Inc. 2000. Preferably, the corrosion inhibitor is selected from the group consisting of alkali metal borates, alkali metal molybdates, hydrocarbyl triazoles, silicates, morpholine, ethylenediamine, pyridine, pyrrolidine and acetylene derivatives.

Preferably, the content of the corrosion inhibitor is within the range of from 0.01 to 5.0 wt.-%, more preferably 0.05 to 1.0 wt.-% and most preferably 0.1 to 0.5 wt.-%, based on the total weight of the emulsion.

Aqueous emulsions especially those containing paraffin are prone to decompose by way of phase separation. Therefore, paraffin-containing cleansing emulsions of the prior art usually have a shelf-life of only 6 months or less.

Preferably, the emulsion according to the invention exhibits a shelf-life under ambient conditions of at least 6 months, more preferably at least 7 months, still more preferably at least 8 months, yet more preferably at least 9 months, most preferably at least 10 months and in particular at least 11 or 12 months. A skilled person is fully aware of suitable methods for determining shelf-life of emulsions. Preferably, shelf-life is determined in accordance with the experimental section.

Preferably, the emulsion according to the invention exhibits antimicrobial activity towards biofilm-forming microorganisms such as *meiothermus silvanus*. Preferably, the emulsion does not eradicate the microorganisms, but merely inhibits their growth.

Methods for estimating the growth of microorganisms in a certain medium are known to the skilled person. For example, the growth of microorganisms can be evaluated by means of a microtiterplate assay test. Within said test, the antimicrobial activity of a substance can be evaluated directly by comparing the growth of the microorganisms in presence of the substance to the growth of the microorganisms in absence of said substance. Accordingly, different antimicrobial substances may be directly compared to each other. The concentration of a colored biofilm forming species in a sample may be determined directly by measuring the absorbance of the sample at a specific wavelength.

In a preferred embodiment, the growth of *meiothermus silvanus* within one day in a sample of white water of a papermaking machine containing 20 ppm of the emulsion is preferably relatively reduced by at least 0.2, 0.4, 0.6, 0.8, 1.0, 1.2, 1.4, 1.6, 1.8, 2, 4, 6, 8 or 10%, more preferably by at least 12, 14, 16, 18 or 20%, still more preferably by at least 22, 24, 26, 28 or 30%, yet more preferably by at least 32, 34, 36, 38 or 40%, and most preferably by at least 42, 44, 46, 48 or 50%, compared to the growth of *meiothermus silvanus* in a sample said white water in absence of the emulsion.

Another aspect of the invention relates to the use of the emulsion described above for removing and/or preventing deposits from surfaces of water-bearing systems, preferably of machines or parts of machines, preferably for processing cellulosic material.

Preferably, the machines or parts of machines are for the manufacture of pulp, paper, paper board, or cardboard. In a preferred embodiment, the water-bearing system is a component of a papermaking plant that is used to accommodate and transfer aqueous fiber suspensions for paper manufacture.

Preferably, the water-bearing system is a circuit system.

When using the emulsion according to the invention, it may be employed continuously or by an interval dosage.

Preferably, the surface is of a component selected from the group consisting of screens, drying screens, felts, filters, membranes, tanks, vessels, towers, pipes, tubes, valves, seals, gaskets, showers, channels, head boxes, frames, scaffolds, pumps, refiners, pulpers, flotation units, rollers, cylinders and wires.

The emulsions to be used according to the invention are most surprisingly suitable as cleaners or agents having an impregnating action against impurities, such as adhesives, resins, waxes, fats, and/or a bitumen-repellent action at any site of pulp, paper, and cardboard-making machines.

The emulsions may be used according to the invention on the surface of the units, in particular under treatment of the units in the wet section of the machines and/or of the units in the drying section.

The emulsions may be used according to the invention while the machine is running (online) or while the machine is stopped (offline). When the machine is stopped, it is preferred that the residence time of the emulsion on the surfaces is several seconds to several minutes. The emulsion may be used in the return movement of the wire, and the wire is optionally inflated with air prior to its contact with the paper web.

The emulsions may be used according to the present invention as such or after dilution with water and/or solvents, preferably water. In general, water having temperatures in the range of 5° C. to 80° C., preferably 20° C. to 50° C., is used for this purpose. Preferably, the emulsion is used in aqueous dilution in a concentration of 0.001-50 wt.-%, more preferably 0.1-20 wt.-%.

According to a preferred embodiment, the added quantity of the emulsions amounts to 1-200 ppm, more preferably 5-100 ppm, most preferably 10-50 ppm, relative to the total water carrying system.

The dilute emulsion may be applied in desired manner, preferably via a spray pipe provided with flat-jet nozzles having an overlapping spray region. In case of wire-cleaning plants, the emulsion may be added to the wash water.

Owing to the action of the agents to be used according to the present invention tacky impurities lose their adhesiveness and are released from the surface of the units, either automatically or when sprayed with water, and are removed.

In a further preferred embodiment of the invention, the water-bearing system is selected from the group consisting of waste water effluents; membrane purification systems; reverse osmosis filtration units; ultrafiltration units; sand filters; steam generating systems; boilers; heat exchangers; evaporative condensers; cooling towers; cooling water systems; closed cooling systems; air washers; devices for heating, ventilating and air conditioning (HVAC); pasteurizers; sterilizers; engines; biodiesel plants; oil separators; medical devices; and devices for processing food.

The water bearing system as such may be selected from the group specified above, or the water-bearing system may be a component of an apparatus, device, unit or system specified above.

In a preferred embodiment the emulsion according to the invention is used for removing and/or preventing deposits from surfaces of membranes. In a preferred embodiment, the membranes are for reversed osmosis, e.g. in kitchens, hospitals, refineries, power plants, food production, semiconductor manufacturing facilities, pharmaceutical manufacturing facilities, manned spacecraft, sailboats, etc. The membranes may also be used in electrodialysis. In another preferred embodiment, the membranes are for membrane bioreactors.

Reversed osmosis is increasingly the technology of choice for many waste water treatment applications. Reversed osmosis is used to create drinking water from well and seawater. It is used to make high purity water for specialized industrial processes such as pharmaceutical and semiconductor manufacturing. Over the past years, reversed osmosis has also increased its market share in the pretreatment of boiler feedwater. Preferred applications include the treatment of circulating cooling water in power stations in order to reduce water consumption and discharge of contaminated waste water, the treatment of pulp and paper effluents for water recovery and chemical reclamation, the treatment of drainage water from coal mines to achieve zero discharge water and produce drinking water and chemical byproducts, the treatment of uranium conversion effluent to facilitate recovery of uranium and yield satisfactorily safe wastewater, the desalination of agricultural drainage to reduce downstream salinity or river, and the desalination of effluent from biologically treated municipal wastewater prior to recharging into the ground.

Examples of suitable membranes are manufactured from, e.g., cellulose acetate, polyamide, and the like. Hollow fine fiber (HFF) membranes and spiral wound (SP) membranes are preferred. The systems may also be coated onto a polysulphone support sheet (thin film composite).

During operation of membranes in water bearing systems, such as in reversed osmosis, deposits form on the surfaces of the membranes. Amount and type of deposits very much depend upon the particular application.

Over time, membrane systems can become fouled with a wide range of materials such as colloids, organic matter and biological organisms. Fouling occurs because material in the feedwater that cannot pass through the membrane is forced onto the membrane surface by the flow of the water going through the membrane. If the "cross" flow (water that does not pass through the membrane) is not sufficient (is not turbulent), or if it is prevented from reaching the membrane (by deposits or a mesh spacer), the material from the feedwater is deposited on the membrane surface.

Fouling increases with increasing flux rate (the flow of water through the membrane) and with decreasing feed flow (velocity). If left uncorrected, the accumulation of these foulants can cause a severe loss of performance in the system: pressure requirements increase to maintain flow, pressure drops increase, and salt rejection can suffer. If the system is not cleaned and continues to build up foulants, the elements may "telescope", or shear internally; causing the integrity of the membrane surface to be compromised and rendering the membrane irreversibly damaged. Fouling tends to occur in membranes at the feed end of the system, where the flux rate is the highest.

Biological fouling can also occur due to the growth of algae or other biological contaminants in the membrane element. Although this type of fouling is caused by contamination rather than flow problems, the resulting blockade of the membrane is the same. The first effect of biofouling on membrane operation is a substantial increase in the electrical costs to operate the unit. If biofouling remains out of control, it can contribute to other combinations of fouling and eventually is responsible for premature membrane replacement.

Scaling of the membrane surface occurs due to the precipitation of sparingly soluble salts. As water passes through the membrane, dissolved minerals from the feedwater become concentrated in the reject stream. If the concentration of the minerals in the reject stream exceeds their solubility products, crystals will precipitate onto the membrane. Scaling occurs first in the last elements of a reversed osmosis system because the feedwater is more concentrated near the end of the process. Typical types of scale that may occur on the reversed osmosis system membranes include calcium and magnesium carbonates, calcium and magnesium sulfates, metal oxides, silica as well as strontium and barium sulfates.

It has been surprisingly found that the emulsion according to the invention may be advantageously used to remove and/or prevent deposits from surfaces of membranes in water-bearing systems, preferably of membranes for reversed osmosis or for membrane bioreactors. The tendency of fouling and scaling can be controlled, whereas hazardous cleansing agents, such as sulfuric acid, may be avoided. Operation efficiency is maintained at high recovery rates.

Cleaning of the membrane can be made in place whereby the piping is provided to allow for recirculation of the emulsion according to the invention, preferably after dilution. In this fashion, valves are manipulated to allow for recirculation of the emulsion through the membrane until the membrane is cleaned to the point where it can be returned into a reverse osmosis system. In some commercially operating systems, a membrane cartridge is removed and placed in a cleaner mode where the emulsion is recirculated through the membrane in the cartridge until the membrane is sufficiently clean for reuse. In either case, the emulsion is prepared which is capable of removing scale and other foulants from the membrane.

The emulsion according to the invention is preferably used for reducing the number of cleaning cycles of membranes.

The emulsion according to the invention may also be used for removing and/or preventing deposits from surfaces of membranes of bioreactors, for improving the performance of membrane bioreactors, or for reducing the number of cleaning cycles of membrane bioreactors.

Membrane bioreactor systems may combine ultra filtration technology with biological treatment for municipal, commercial and industrial wastewater treatment and water reuse applications. The membrane bioreactor (MBA) process is an emerging advanced wastewater treatment technology that has been successfully applied at an ever increasing number of locations around the world. Membrane bioreactor systems preferably incorporate reinforced hollow fiber membranes specifically designed to meet the requirements of wastewater treatment. For details it may be referred to e.g. S. Judd, The MBR Book: Principles and Applications of Membrane Bioreactors for Water and Wastewater Treatment, Elsevier Science, 2006.

In another preferred embodiment the emulsion according to the invention is used for removing and/or preventing deposits from surfaces of sand filters in water-bearing systems. Sand filters may be used for water purification. There are three main types:

rapid (gravity) sand filters, upflow sand filters and slow sand filters. All three methods are used extensively in the water industry throughout the world. The first two usually require the use of flocculant chemicals to work effectively whilst slow sand filters can produce very high quality water free from pathogens, taste and odor without the need for chemical aids. Passing flocculated water through a rapid gravity sand filter strains out the floc and the particles trapped within it reducing numbers of bacteria and removing most of the solids. The medium of the filter is sand of varying grades. Where taste and odor may be a problem (organoleptic impacts), the sand filter may include a layer of activated carbon to remove such taste and odor.

Sand filters are occasionally used in the treatment of sewage as a final polishing stage. In these filters the sand traps residual suspended material and bacteria and provides a physical matrix for bacterial de-emulsion of nitrogenous material, including ammonia and nitrates, into nitrogen gas.

Sand filters become clogged with floc after a period in use and they are then backwashed or pressure washed to remove the floc. This backwash water is run into settling tanks so that the floc can settle out and it is then disposed of as waste material. The supernatant water is then run back into the treatment process or disposed off as a waste-water stream. In some countries the sludge may be used as a soil conditioner. Inadequate filter maintenance has been the cause of occasional drinking water contamination. For further details it can be referred to e.g. D. Purchas, Handbook of Filter Media, Elsevier Science; 1st Ed edition, 1996 and I. M. Marshall Hutten, Handbook of Nonwoven Filter Media, Elsevier Science, 2007.

It has been surprisingly found that the emulsion according to the invention may be advantageously used for removing and/or preventing deposits from the surface of sand in sand filters, preferably during backwashing.

In yet another preferred embodiment the emulsion according to the invention is used for removing and/or preventing deposits from surfaces of heat exchangers.

A heat exchanger is a device built for efficient heat transfer from one fluid to another, whether the fluids are separated by a solid wall so that they never mix, or the fluids are directly contacted. Heat exchangers are widely used in petroleum refineries, chemical plants, petrochemical plants, natural gas processing, refrigeration, power plants, air conditioning and space heating. Typical heat exchangers are shell and tube heat exchangers, plate heat exchangers, regenerative heat exchangers, adiabatic wheel heat exchangers, fluid heat exchangers, dynamic scraped surface heat exchangers, phase-change heat exchangers and HVAC air coils.

According to the invention, phase-change heat exchangers are preferred. In addition to heating up or cooling down fluids in just a single phase, phase-change heat exchangers can be used either to heat a liquid to evaporate (or boil) it or used as condensers to cool a vapor to condense it back to a liquid. In chemical plants and refineries, reboilers used to heat incoming feed for distillation towers are often phase-change heat exchangers. Distillation set-ups typically use condensers to condense distillate vapors back into liquid. Power plants which have steam-driven turbines commonly use phase-change heat exchangers to boil water into steam. Phase-change heat exchangers or similar units for producing steam from water are often called boilers. In the nuclear power plants called pressurized water reactors, special large phase-change heat exchangers which pass heat from the primary (reactor plant) system to the secondary (steam plant) system, producing steam from water in the process, are called "steam generators". All power plants, fossil-fueled and nuclear, using large quantities of steam have large condensers to recycle the water back to liquid form for re-use. In order to conserve energy and cooling capacity in chemical and other plants, regenerative phase-change heat exchangers can be used to transfer heat from one stream that needs to be cooled to another stream that needs to be heated, such as distillate cooling and reboiler feed pre-heating. The term "phase-change heat exchanger" can also refer to heat exchangers that contain a material within their structure that has a change of phase. This is usually a solid to liquid phase due to the small volume difference between these states. This change of phase effectively acts as a buffer because it occurs at a constant temperature but still allows the heat exchanger to accept additional heat. One example where this has been investigated is for use in high power aircraft electronics.

Preferably, the phase-change heat exchanger is a condenser selected from the group consisting of evaporative cooling systems, evaporative condensers, water-cooled condensers, dry coolers, evaporative coolers, cooling towers, and evaporative industrial fluid coolers. Such heat-exchangers are known to the skilled artisan. For further details it can be referred to e.g. S. Kakac et al., Heat Exchangers: Selection, Rating and Thermal Design, CRC; 2 edition, 2002; R. K. Shah, Fundamentals of Heat Exchanger Design, Wiley; 1 edition, 2002; J. E. Brumbaugh, Audel HVAC Fundamentals, Air Conditioning, Heat Pumps and Distribution Systems, Audel; 4 Sub edition, 2004; and S. Kakac, Boilers, Evaporators, and Condensers, Wiley-Interscience; 1 edition, 1991.

Preferably, a cooling tower is a device whose main purpose is to cool a fluid, usually water, by direct contact between that fluid and a stream of gas, usually air. Preferably, an evaporative condenser is a device whose main purpose is to cool a fluid by passing that fluid through a heat exchanger which is itself cooled by contact with another fluid, usually water, passing through a stream of air.

It has been surprisingly found that the emulsion according to the invention may be advantageously used for removing and/or preventing deposits from the surface of heat exchangers, preferably phase-change heat exchangers, more preferably condensers, most preferably evaporative condensers.

In yet another preferred embodiment the emulsion according to the invention is used for removing and/or preventing deposits from surfaces of steam generating systems or boilers. It has been surprisingly found that the emulsion according to the invention may be advantageously used for removing and/or preventing deposits from the surface of steam generating systems or boilers.

A further aspect of the invention relates to a method for removing and/or preventing deposits from surfaces of water-bearing systems, preferably of machines or parts of machines, preferably for processing cellulosic material, comprising the step of treating a surface, preferably a surface of a machine or a part of a machine, with the emulsion according to the invention. Preferably, the water-bearing system is a component of a papermaking plant that is used to accommodate and transfer aqueous fiber suspensions for paper manufacture. The method for removing and/or preventing deposits from surfaces of water-bearing systems comprises the step of treating the surfaces with the emulsion according to the invention. Preferably, the method comprises the step of diluting the emulsion with water before treating the surfaces.

In a preferred embodiment, the emulsion according to the invention is used for preventing the formation of deposits in a water-bearing system of a papermaking machine. Preferably, the emulsion is added to the white water of the papermaking machine.

Preferably, the emulsion is employed at a dosage of at most 2000 g/t (product/paper), more preferably of at most 1750 g/t (product/paper), still more preferably of at most 1500 g/t (product/paper), yet more preferably of at most 1250 g/t (product/paper), most preferably of at most 1000 g/t (product/paper), and in particular of at most 750 g/t or at most 700 g/t (product/paper).

It has been surprisingly found that the above dosages of the emulsion added to the white water of a papermaking machine is sufficient to prevent the formation of deposits and/or foam for at least 5 days, more preferably at least 10 days, still more preferably at least 15 days, yet more preferably at least 20 days, most preferably at least 25 days, and in particular 30 days.

The skilled person is fully aware of the meaning of the term "treating". For the purpose of the specification, the term "treating" shall include contacting, adding, spraying, pouring, bathing, dipping, coating, and the like. Treating may also include mechanical action, such as rubbing, brushing, wire brushing, shot blasting, and the like. The duration of the treatment depends on the individual circumstances. Depending on the kind of deposit, exposure times may vary from a few seconds to several minutes or even hours. Suitable conditions may be revealed by routine experimentation.

Further preferred embodiments of the method according to the invention become apparent from the description of the other aspects of the invention supra.

EXAMPLES

The following examples further illustrate the invention but are not to be considered as limiting its scope.

Example 1

The following comparative cleansing emulsions were prepared:

| | [wt.-%] | C-1 | C-2 | C-4 | C-5 | C-6 |
|---|---|---|---|---|---|---|
| | water | >70 | >70 | <50 | >70 | >70 |
| H1 | solid paraffin | ca. 10 | — | — | — | — |
| | orange terpene | — | ca. 15 | ca. 50 | ca. 10 | — |
| H2 | dibutyladipate | — | — | — | — | ca. 10 |
| E1 | hexadecanol | <2 | — | — | <1 | — |
| | fatty alcohol ($C_{12}$-$C_{18}$), ethoxylated | — | <2 | <2 | — | — |
| E2 | castor oil, ethoxylated | — | <10 | <10 | ca. 10 | <10 |
| | fatty alcohol ($C_{16}$-$C_{18}$), ethoxylated | <5 | — | — | — | — |
| E3 | oleyl alcohol, ethoxylated (HLB = 15) | <5 | — | — | — | — |
| | oleyl alcohol, ethoxylated (HLB = 15-20) | — | <5 | <5 | — | — |

The following cleansing emulsions according to the invention were prepared.

| | [wt-%] | I-1 | I-2 | I-3 | I-4 | I-5 | I-6 | I-7 | I-8 | I-9 | I-10 | I-11 | I-12 | I-13 | I-14 | I-15 | I-16 |
|---|---|---|---|---|---|---|---|---|---|---|---|---|---|---|---|---|---|
| | water | >70 | >70 | >70 | >70 | >70 | >70 | >70 | >70 | >70 | >70 | >70 | >70 | >70 | >70 | >70 | >70 |
| $H_1$ | solid paraffin | <15 | <15 | <15 | <15 | <15 | <15 | <10 | — | — | — | — | — | — | — | — | — |
| | orange terpene | — | — | — | — | — | — | — | <15 | <15 | <15 | <15 | <10 | <10 | <10 | <10 | <10 |
| $H_2$ | clove oil | <1 | <5 | — | — | — | — | — | <1 | <5 | — | — | <1 | <5 | — | — | — |
| | neem oil | — | — | <1 | <5 | — | — | — | — | — | <1 | <5 | — | — | <1 | <5 | — |
| | thyme oil | — | — | — | — | <1 | <5 | — | — | — | — | — | — | — | — | — | — |
| | liquid paraffin | — | — | — | — | — | — | <10 | — | — | — | — | — | — | — | — | — |
| | solid paraffin | — | — | — | — | — | — | — | — | — | — | — | — | — | — | — | <10 |
| $E_1$ | hexadecanol | ca. 1 | ca. 1 | ca. 1 | ca. 1 | ca. 1 | ca. 1 | ca. 1 | — | — | — | — | <1 | <1 | <1 | <1 | <1 |
| | fatty alcohol ($C_{12}$-$C_{18}$), ethoxylated | — | — | — | — | — | — | — | ca. 1 | ca. 1 | ca. 1 | ca. 1 | — | — | — | — | <1 |
| $E_2$ | castor oil, ethoxylated | — | — | — | — | — | — | — | <10 | <10 | <10 | <10 | <15 | <15 | <15 | <15 | <10 |
| | fatty alcohol ($C_{16}$-$C_{18}$), ethoxylated | <5 | <5 | <5 | <5 | <5 | <5 | <5 | — | — | — | — | — | — | — | — | <5 |
| $E_3$ | oleyl alcohol, ethoxylated (HLB = 15) | <5 | <5 | <5 | <5 | <5 | <5 | <5 | — | — | — | — | — | — | — | — | ca. 1 |
| | oleyl alcohol, ethoxylated (HLB = 15-20) | — | — | — | — | — | — | — | <5 | <5 | <5 | <5 | — | — | — | — | <1 |
| | alkyl polysaccharide | — | — | — | — | — | — | — | — | — | — | — | — | — | — | — | — |

| | [wt.-%] | I-17 | I-18 | I-19 | I-20 | I-21 | I-22 | I-23 | I-24 |
|---|---|---|---|---|---|---|---|---|---|
| | water | >70 | >70 | >70 | >70 | >70 | >70 | >70 | >70 |
| $H_1$ | solid paraffin | — | — | — | — | — | — | — | — |
| | orange terpene | — | — | — | — | — | — | — | — |
| | vegetable oil alkyl ester 1 | <10 | <10 | <10 | <10 | <10 | — | — | — |
| | vegetable oil alkyl ester 2 | — | — | — | — | — | <10 | <15 | <15 |
| $H_2$ | pinene | <5 | — | — | — | — | — | — | <5 |
| | neem oil | — | <5 | — | — | — | — | — | — |

-continued

| | | | | | | | | | |
|---|---|---|---|---|---|---|---|---|---|
| | thyme oil | — | — | ca. 5 | — | — | — | ca. 5 | — |
| | liquid paraffin | — | — | — | <7.5 | — | — | — | — |
| | solid paraffin | — | — | — | — | <7.5 | <7.5 | — | — |
| $E_1$ | hexadecanol | <1 | <1 | <1 | <1 | <1 | <1 | <1 | <1 |
| | fatty alcohol ($C_{12}$-$C_{18}$), ethoxylated | <1 | <1 | <1 | <1 | <1 | <1 | <1 | <1 |
| $E_2$ | castor oil, ethoxylated | <10 | <10 | <10 | <10 | <10 | <10 | <10 | <10 |
| | fatty alcohol ($C_{16}$-$C_{18}$), ethoxylated | <5 | <5 | <5 | <5 | <5 | <5 | <5 | <5 |
| $E_3$ | oleyl alcohol, ethoxylated (HLB = 15) | ca. 1 | ca. 1 | ca. 1 | ca. 1 | ca. 1 | ca. 1 | ca. 1 | ca. 1 |
| | oleyl alcohol, ethoxylated (HLB = 15-20) | <1 | <1 | <1 | <1 | <1 | <1 | <1 | <1 |
| | alkyl polysaccharide | — | — | — | — | — | — | — | — |

Those cleansing emulsions containing paraffin (comparative example C-1 and inventive examples I-1 to I-7 and I-15) and thus being especially prone to decomposition were subjected to stability testing at room temperature. The test results are given below.

| | Stability at r.t. | | | | | | |
|---|---|---|---|---|---|---|---|
| | 1 month | 3 month | 6 month | 9 month | 12 month | 15 month | 24 months |
| C-1 | stable | stable | stable | particle occurence | foaming & layering | | |
| I-1 | stable | stable | stable | stable | stable | stable | stable |
| I-2 | stable | stable | stable | stable | stable | stable | stable |
| I-3 | stable | stable | stable | stable | stable | stable | |
| I-4 | stable | stable | stable | stable | stable | stable | |
| I-5 | stable | stable | stable | stable | | | |
| I-6 | stable | stable | stable | stable | | | |
| I-7 | stable | stable | stable | stable | stable | stable | |
| I-16 | stable | stable | stable | stable | stable | stable | |

As a result, all inventive cleansing emulsions containing a combination of two hydrophobic compounds exhibited an increases shelf stability compared to the comparative example which contained only one hydrophobic compound.

Example 2

The effectiveness of the cleansing emulsions in preventing deposit formation was tested by means of a microtiterplate assay test (MIITU-test). The test was conducted twice:

First with a pure culture of *meiothermus silvanus* in sterilized artificial wire water and second with a pure culture of *meiothermus silvanus* in a clear filtrate of a papermaking machine's wire water. The corresponding samples containing only *meiothermus silvanus* (and no cleansing emulsion) were included into the assay test as reference. For each sample, the concentration of *meiothermus silvanus* was determined by staining with crystal violet and measuring the absorbance at 595 nm.

The results of the MIITU-test are depicted in FIGS. 1 to 4.

Figure 3:
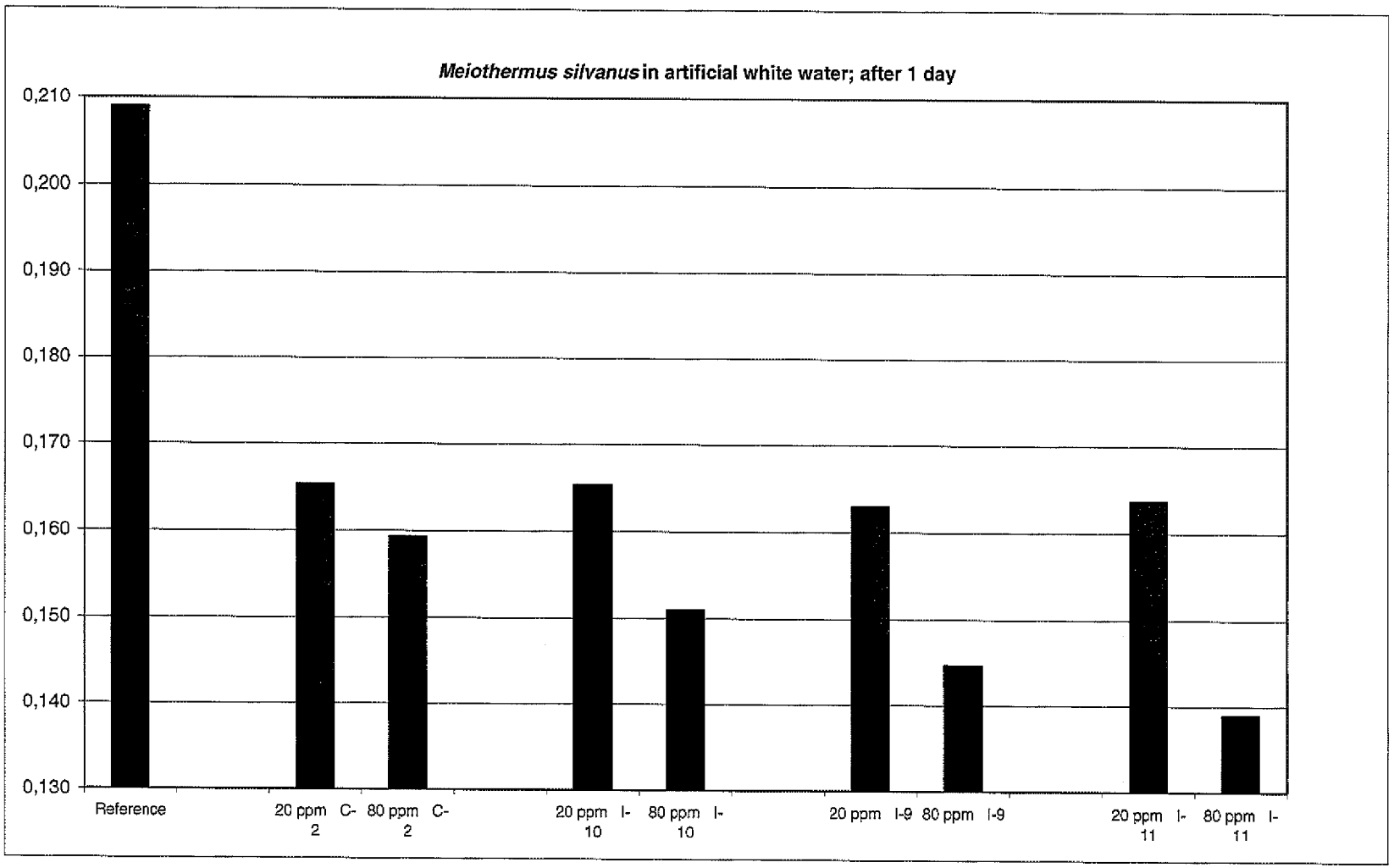
FIG. 3, illustrates results of a microtiterplate assay test of the present inventions ability to prevent deposit formation with comparative cleaning emulsion C-2.
Figure 4:
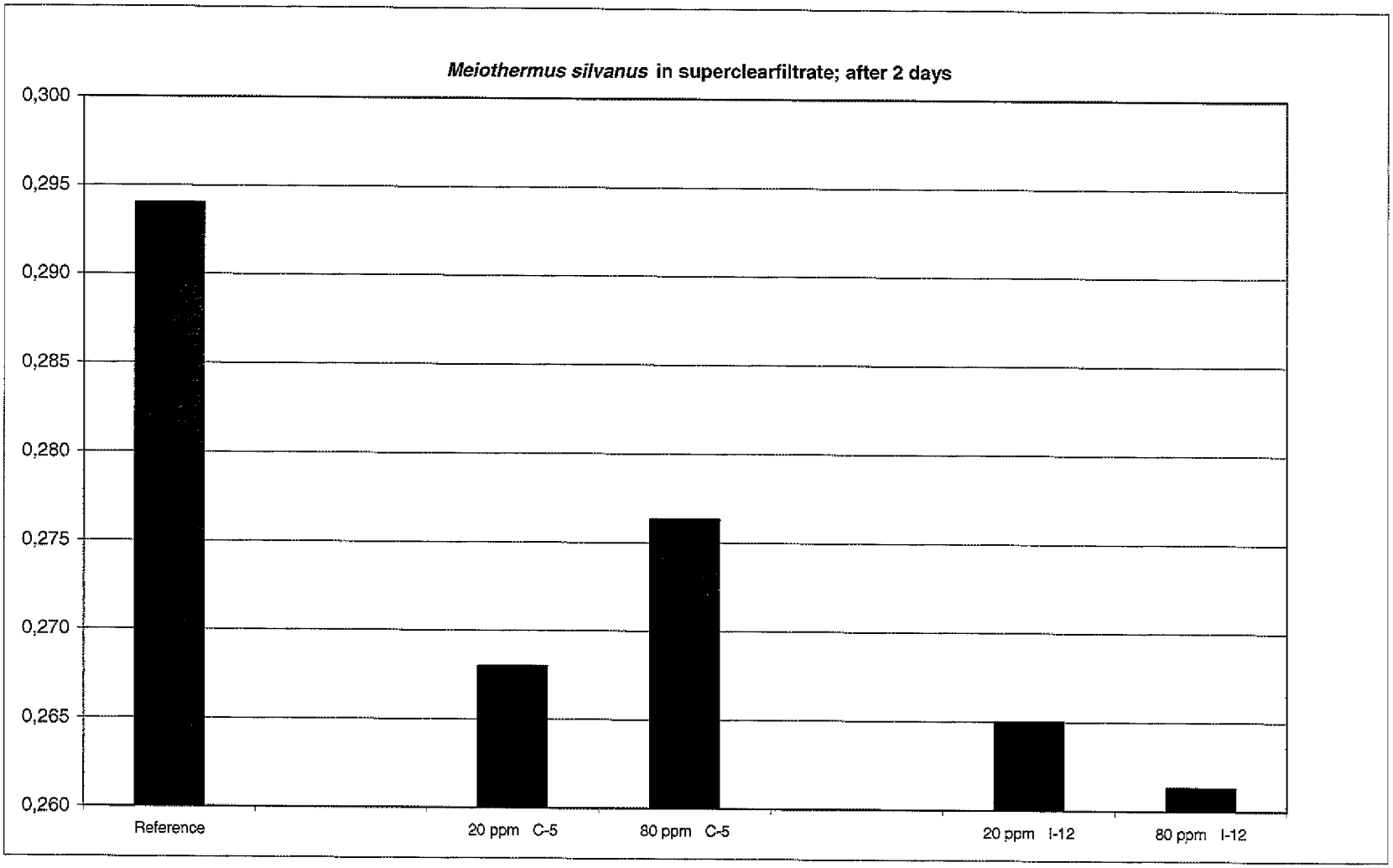
FIG. 4, illustrates results of a microtiterplate assay test of the present invention with comparative cleaning emulsion C-5.

As can clearly be seen from FIGS. 1 to 4, the inventive cleansing emulsions I-1 to I-4 and I-9 to I-15 showed an improved performance in preventing deposit formation compared to comparative cleansing emulsion C-1 (FIG. 1), C-5 (FIGS. 2 and 4) and C-2 (FIG. 3).

Additionally, the antimicrobial activity of each sample was tested in a biocide screening. The inventive examples were tested in concentrations of 20 ppm, 80 ppm and 160 ppm and none of the tested inventive cleansing emulsions exhibited a killing effect.

Example 3

According to Example 2, a microtiterplate assay test was done in order to evaluate the ability of inventive cleansing emulsion I-16 to prevent deposit formation. The test was conducted with a pure culture of *meiothermus silvanus* in R2A agar as nutrient bacterial culture broth.

Figure 5:
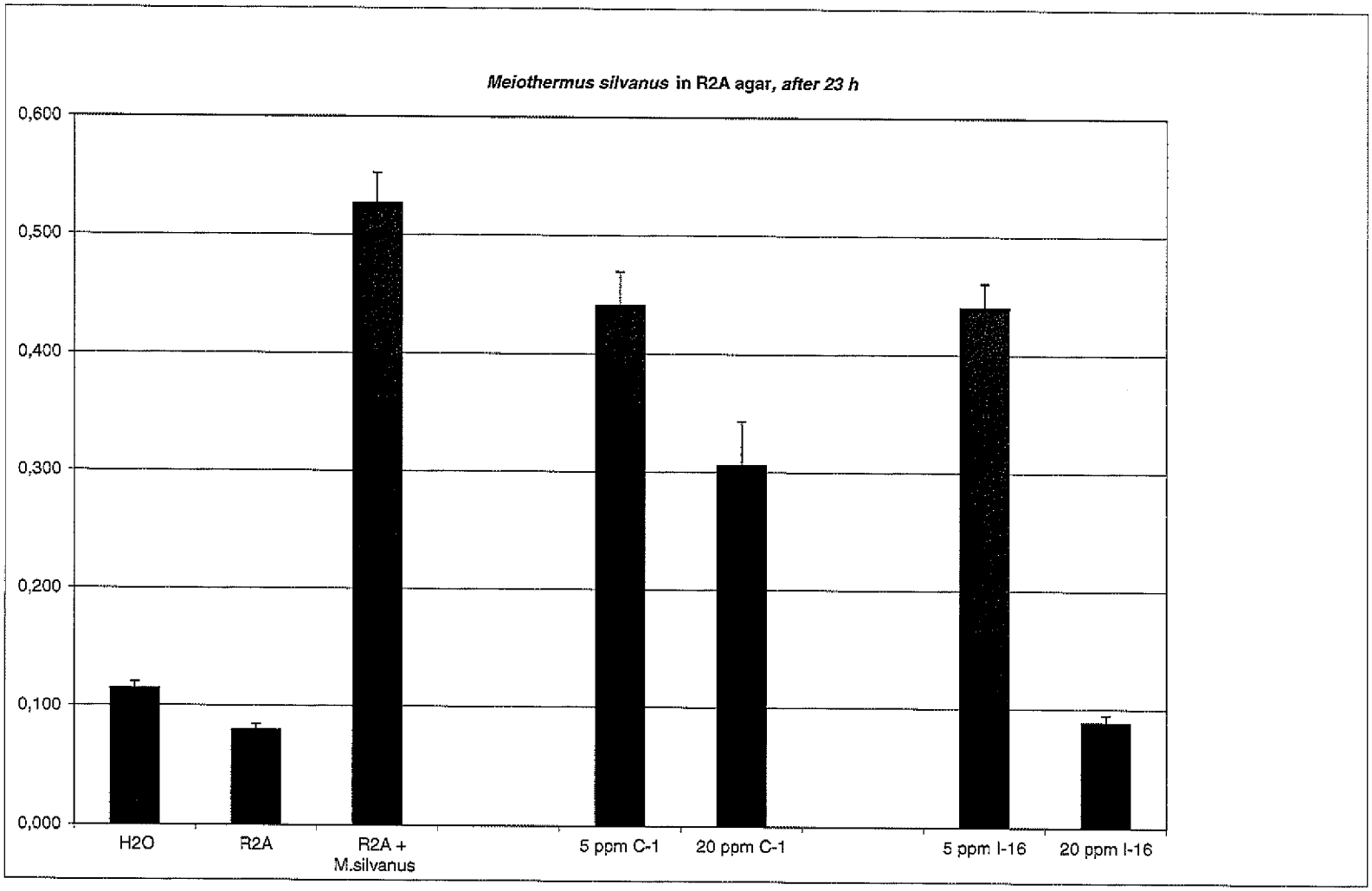
FIG. 5, illustrates results of a microtiterplate assay test evaluating the ability of the composition of the present invention to prevent deposit formation.
Figure 6:
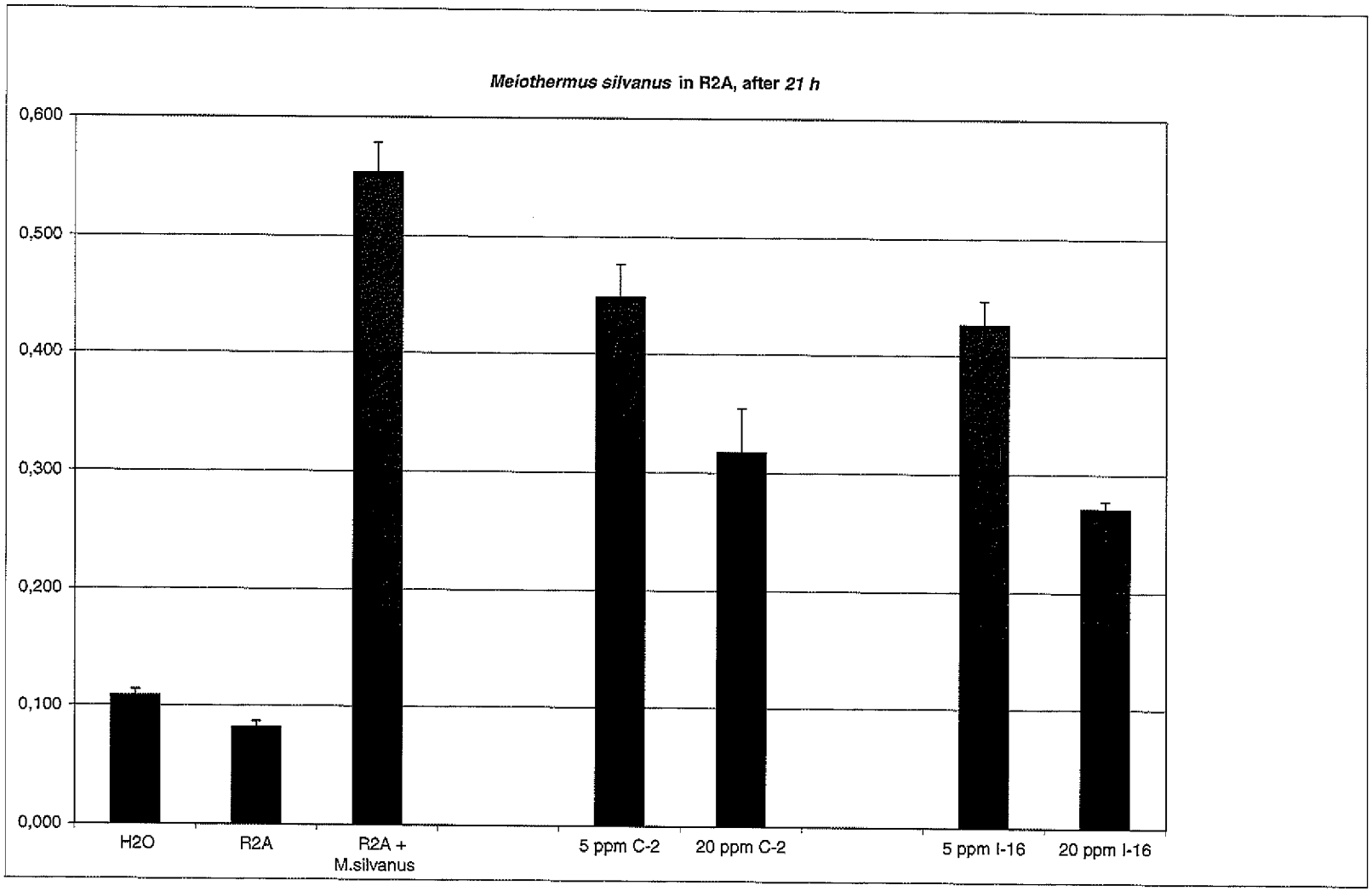
FIG. 6, illustrates results of a microtiterplate assay test evaluating the ability of the composition of the present invention to prevent deposit formation.

The results are depicted in FIGS. 5 and 6. All results are averages from 2 plates.

As a result, it can be seen that the inventive cleansing emulsion I-16 exhibits a superior performance to the state-of-art standard (C-1 and C-2) against *meiothermus silvanus* in R2A agar.

Example 4

In a cardboard machine, in which usually comparative emulsion C-2 is employed as deposit control agent, the inventive emulsion I-16 as described in example 1 was added to the white water instead. The dosage was maintained at 400 g/t (product/paper). After 36 days, the head box and its upstream pipes did not show any visible deposits except for cellulosic material.

Apparently, the presence of inventive emulsion I-16 prevented the formation of deposits. Furthermore, inventive emulsion I-16 also showed an improved anti-foaming ability compared to comparative emulsion C-2. During the study period, hardly any foam formation was observed at the surface of the wire pit water.

Subsequently, the treatment of the white water with comparative emulsion C-2 as deposit control agent was resumed. After 10 more days, the head box and its upstream pipings were examined and again did not show any visible deposits except for cellulosic material.

Summarizing, inventive example I-16 showed an improved anti-foaming ability compared to comparative example C-1, while the performance in terms of deposit control was at least kept at the same level.

Example 5

After a cleaning standstill of a paper making machine, inventive emulsion I-16 was employed as deposit control agent. The dosage was 700 g/t (product/paper). The deposits were controlled with a known coupon system (cf. WO 2006/097321) in the white water I box. After 6 days and 14 days, respectively, the coupons were taken out and analyzed in accordance with WO/2006/097321. The results showed very low deposit amounts.

As a result of the treatment with inventive emulsion I-16, the thin stock system did not have to be cleaned during the whole trial period and as a consequence, the number of breaks was reduced.

We claim:

1. An aqueous cleansing emulsion comprising (a) a hydrophobic component $H_1$ selected from the group consisting of the following categories:
- (i) aliphatic $C_{10}$- or $C_{15}$-terpene hydrocarbons;
- (ii) aliphatic $C_{10}$- or $C_{15}$-terpenoids;
- (iii) aliphatic $C_{15}$-$C_{40}$-hydrocarbons; and
- (iv) $C_5$-$C_{30}$-carboxylic acid $C_1$-$C_{30}$-alkyl esters;

(b) a hydrophobic component $H_2$ selected from the group consisting of the following categories:
- (iii) aliphatic $C_{15}$-$C_{40}$-hydrocarbons;
- (iv) $C_6$-$C_{30}$-carboxylic acid $C_1$-$C_{30}$-alkyl esters;
- (v) aliphatic $C_6$-$C_{19}$-hydrocarbons;
- (vi) aromatic $C_{10}$- or $C_{15}$-terpenoids;
- (vii) aliphatic or aromatic $C_{20}$-, $C_{25}$-, $C_{30}$- or $C_{35}$-terpenoids;
- (viii) essential, animal or vegetable oils; and
- (ix) silicon oils;

with the proviso that both $H_1$ and $H_2$ are not selected from category (iii) or from category (iv) at the same time;

(c) an emulsifier $E_1$ having a HLB value of 4±2;

(d) an emulsifier $E_2$ having a HLB value of 9±2; and (e) optionally, an emulsifier $E_3$ having an HLB value of 16±4.

2. The emulsion according to claim 1, wherein category (i) comprises monocyclic saturated or unsaturated $C_{10}$-terpene hydrocarbons; and/or category (ii) comprises monocyclic saturated or unsaturated aliphatic $C_{10}$-terpene alcohols; and/or category (iii) comprises aliphatic $C_{20}$-$C_{40}$-alkanes and aliphatic $C_{20}$-$C_{40}$-alkenes.

3. The emulsion according to claim 1, wherein category (iv) comprises monoesters of linear, saturated or unsaturated mono-carboxylic acids or diesters of linear, saturated or unsaturated dicarboxylic acids; and/or category (vi) comprises aromatic $C_{10}$-terpene alcohols; and/or category (vii) comprises tetranortriterpenoids.

4. The emulsion according to claim 1, wherein the (viii) essential, animal or vegetable oils are selected from the group consisting of amyris oil, almond oil, anise oil, balm oil, basil oil, bay oil, bergamot oil, birch oil, birch tar oil, black pepper oil, borage oil, cade oil, camphor white oil, canaga oil, cardamom oil, carrot seed oil, cassia oil, castor oil, cedar leaf oil, cedarwood oil, celery seed oil, chamomile oil, cinnamon bark oil, cinnamon leaf oil, cinnamon oil, citronella oil, clary sage oil, clove oil, clove bud oil, cod liver oil, cognac oil, copaiba balsam oil, coriander oil, corn oil, cornmint oil, coconut oil, costus oil, cottonseed oil, croton oil, dillweed oil, eucalyptus oil, fennel oil, fir needle oil, fish liver oil, galbanum oil, garlic oil, ginger oil, grapefruit oil, guaiac wood oil, jojoba oil, lard oil, lavender oil, lemon oil, lemongrass oil, lime oil, linseed oil, litsea cubeba oil, lovage oil, macadamia nut oil, marjoram oil, mandarin oil, menhaden fish oil, myrrh oil, neem oil, nutmeg oil, olibanum oil, olive oil, onion oil, opoponax oil, orange oil, orange terpenes, osmanthus oil, parsley oil, patchouli oil, peanut oil, peppermint oil, petitgrain oil, pimenta leaf oil, rose oil, rosemary oil, safflower oil, sage oil, sandalwood oil, sassafras oil, sesame oil, soybean oil, spearmint oil, spike lavender oil, sunflower seed oil, tarragon oil, tea tree oil, terpineol, turpentine oil, thyme oil, wheat germ oil, wintergreen oil, ylang-ylang oil.

5. The emulsion according to claim 1, wherein $H_1$ is selected from category (i) and $H_2$ is selected from category (iii); or $H_1$ is selected from category (i) and $H_2$ is selected from category (iv); or $H_1$ is selected from category (i) and $H_2$ is selected from category (v); or $H_1$ is selected from category (i) and $H_2$ is selected from category (vi); or $H_1$ is selected from category (i) and $H_2$ is selected from category (vii); or $H_1$ is selected from category (i) and $H_2$ is selected from category (viii); or $H_1$ is selected from category (i) and $H_2$ is selected from category (ix); or $H_1$ is selected from category (ii) and $H_2$ is selected from category (iii); or $H_1$ is selected from category (ii) and $H_2$ is selected from category (iv); or $H_1$ is selected from category (ii) and $H_2$ is selected from category (v); or $H_1$ is selected from category (ii) and $H_2$ is selected from category (vi); or $H_1$ is selected from category (ii) and $H_2$ is selected from category (vii); or $H_1$ is selected from category (ii) and $H_2$ is selected from category (viii); or $H_1$ is selected from category (ii) and $H_2$ is selected from category (ix); or $H_1$ is selected from category (iii) and $H_2$ is selected from category (iv); or $H_1$ is selected from category (iii) and $H_2$ is selected from category (v); or $H_1$ is selected from category (iii) and $H_2$ is selected from category (vi); or $H_1$ is selected from category (iii) and $H_2$ is selected from category (vii); or $H_1$ is selected from category (iii) and $H_2$ is selected from category (viii); or $H_1$ is selected from category (iii) and $H_2$ is selected from category (ix); or $H_1$ is selected from category (iv) and $H_2$ is selected from category (v); or $H_1$ is selected from category (iv) and $H_2$ is selected from category (vi); or $H_1$ is selected from category (iv) and $H_2$ is selected from category (vii); or $H_1$ is selected from category (iv) and $H_2$ is selected from category (viii); or $H_1$ is selected from category (iv) and $H_2$ is selected from category (ix).

6. The emulsion according to claim 1, wherein emulsifier $E_1$ is a $C_{12}$-$C_{18}$-alkylalcohol; and/or emulsifier $E_2$ is selected from the group consisting of polyethoxylated $C_{16}$-$C_{18}$ alkylalcohols and polyethoxylated castor oil; and/or emulsifier $E_3$ is selected from the group consisting of ethoxylated $C_{16}$-$C_{18}$ alkylalcohols, ocenol and alkylpolysaccharides.

7. The emulsion according to claim 1, wherein the water content is within the range of from 10 to 90 wt.-%, based on the total weight of the emulsion.

8. The emulsion according to claim 1, wherein the overall content of all emulsifiers is within the range of from 5.0 to 15 wt.-%, based on the total weight of the emulsion.

9. A method for removing and/or preventing deposits from surfaces of water-bearing systems comprising the step of treating the surfaces with an emulsion as defined in claim 1.

10. The method according to claim 9, wherein the water-bearing system is a component of a papermaking plant that is used to accommodate and transfer aqueous fiber suspensions for paper manufacture.

11. The method according to claim 10, further comprising the step of diluting the emulsion with water before treating the surfaces.

* * * * *